US007568457B2

(12) United States Patent
Kusaka et al.

(10) Patent No.: US 7,568,457 B2
(45) Date of Patent: Aug. 4, 2009

(54) VALVE DRIVING DEVICE FOR MULTI-CYLINDER INTERNAL COMBUSTION ENGINE

(75) Inventors: Yasushi Kusaka, Susono (JP); Shuichi Ezaki, Susono (JP); Toshiaki Asada, Mishima (JP); Kimitoshi Tsuji, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 287 days.

(21) Appl. No.: 11/597,563

(22) PCT Filed: Jun. 2, 2005

(86) PCT No.: PCT/JP2005/010525

§ 371 (c)(1),
(2), (4) Date: Jan. 5, 2007

(87) PCT Pub. No.: WO2005/119019

PCT Pub. Date: Dec. 15, 2005

(65) Prior Publication Data

US 2008/0017151 A1 Jan. 24, 2008

(30) Foreign Application Priority Data

Jun. 3, 2004 (JP) ..... 2004-165704
Jun. 3, 2004 (JP) ..... 2004-165716

(51) Int. Cl.
*F01L 1/34* (2006.01)

(52) U.S. Cl. ..... 123/90.16; 123/90.15; 123/90.11; 123/90.31

(58) Field of Classification Search ..... 123/90.11, 123/90.15, 90.16, 90.31
See application file for complete search history.

(56) References Cited

U.S. PATENT DOCUMENTS

2004/0118367 A1* 6/2004 Ezaki et al. ..... 123/90.11
2005/0211207 A1 9/2005 Urushihata et al.

FOREIGN PATENT DOCUMENTS

| | | |
|---|---|---|
| JP | B2 1-16964 | 3/1989 |
| JP | Y2 2-27123 | 7/1990 |
| JP | A 6-193415 | 7/1994 |
| JP | A 2002-500311 | 1/2002 |
| JP | A 2003-170764 | 6/2003 |
| JP | A 2004-137942 | 5/2004 |
| WO | WO 2004/038200 A1 | 5/2004 |

* cited by examiner

*Primary Examiner*—Zelalem Eshete
(74) *Attorney, Agent, or Firm*—Oliff & Berridge, PLC

(57) ABSTRACT

A valve driving device (10), that converts rotational motion outputted from a valve-driving source to linear motion through cam mechanisms (13) provided to respective cylinders (2) and drives valves (3) in respective cylinders through the linear motion, the valve driving device is equipped with electric motors (11, 12) that are shared as the valve-driving source in a group of cylinders comprising a plurality of cylinders in which open-valve periods of the valves do not overlap; and motion-transmission mechanisms (14, 15) that transmit rotational motion of the electric motors (11, 12) to cams (16) in respective cam mechanisms (13) in the group of cylinders.

16 Claims, 20 Drawing Sheets

FIG.8

| FREEDOM | LIFT SHAPE |
|---|---|
| A : PHASE | |
| B : WORKING ANGLE & LIFT AMOUNT | |
| C : WORKING ANGLE | |
| D : LIFT AMOUNT | |
| E : LIFT SPEED | |
| F : VARIABLE CYCLE | |
| G : IN STRATIFIED COMBUSTION | |
| H : VALVE-STOPPED | |

VALVE DRIVING DEVICE FOR MULTI-CYLINDER INTERNAL COMBUSTION ENGINE

TECHNICAL FIELD

The present invention relates to a valve driving device that is employed in a multi-cylinder internal combustion engine and drives to open and close valves of respective cylinders of the internal combustion engine.

RELATED ART

A type of valve driving device is disclosed, for example in Japanese Examined Patent Publication No. 1989-16964, that drives at least either an intake valve or an exhaust valve with a stepping motor. Another type of valve driving device is also disclosed, for example in Japanese Examined Utility Model Publication No. 1990-27123, that includes for each valve an electric motor and a cam mechanism for converting the rotational motion of the electric motor into a linear motion of the valve. Furthermore, Japanese National Phase Patent Publication No. 2002-500311 is related to the present invention as an earlier reference.

DISCLOSURE OF THE INVENTION

When an electric motor is controlled to change an operating characteristic of a valve in a case of sharing the electric motor as a source of driving valves in a plurality of cylinders of a multi-cylinder internal combustion engine, the motor may effect the operating characteristics of other valves having open-valve periods that overlap with the open-valve period of the valve to be altered. Thus, the flexibility of controlling operating characteristic of a valve is restricted. On the other hand, when an electric motor is employed to each valve, the operating characteristic of a valve may be varied flexibly for each valve. However, the valve driving device grows in size and the restriction of mounting the valve driving device on a vehicle increases, as the number of electric motor increases.

It is an object of the present invention to provide a downscalable valve driving device able to control the operating characteristics of valves flexibly.

To accomplish the above object, the valve driving device for a multi-cylinder internal combustion engine according to an aspect of the present invention converts rotational motion outputted from a valve-driving source to linear motion through motion-converting devices provided to respective cylinders, drives valves in respective cylinders through the linear motion, and includes an electric motor that is shared as the valve-driving source in a group of cylinders comprising a plurality of cylinders in which open-valve periods of the valves do not overlap.

According to the above valve driving device, the device is reduced in size and the restriction of mounting the valve driving device is relaxed as compared to the case when an electric motor is provided for each cylinder, since an electric motor is shared as a valve-driving source in a plurality of cylinders. Furthermore, the open-valve periods do not overlap in a group of cylinders sharing an electric motor, and thus there exist periods when all of the valves are closed between the open-valve periods of valves. Therefore, in a case that the operating characteristic of a valve (either intake valve or exhaust valve) of a cylinder in a group of cylinders has been altered by varying the rotation speed and direction of an electric motor, the effect of changes in the operating characteristic of the previously opened valve on the operating characteristic of the next opening valve is canceled by further varying the rotation of the electric motor so as to cancel the previous changes in the period between the time when the previously opened valve is closed and the time when the next opening valve is to be opened (the period when all of the valves are closed). For example, in a case that an electric motor is accelerated in an open-valve period of a valve so as to reduce a working angle of the valve, the positional shift of the starting point of opening the next valve is fixed by slowing down the electric motor in correspondence with the accelerated amount before the next valve opens. Thus, a similar change to the previous valve or a unique change in the working angle is provided to the next valve by controlling the electric motor. Furthermore, in a case that an operating characteristic of a valve has been altered by combining stopping and reverse rotating the electric motor, the operation of each valve is controlled without affecting the operations of other valves by controlling the rotation of the electric motor so as to cancel the previous variation before the next valve opens. Thus, the operating characteristic of each cylinder may be controlled flexibly. It is noted that varying a rotation speed in this description includes the concept of controlling the rotation speed to be zero, namely, stopping the rotation of the electric motor.

In an aspect of the valve driving device of the present invention, the valve driving device may further include a motion-transmission mechanism that transmits rotational motion of the electric motor to rotating bodies of respective motion-converting devices in the group of cylinders. Furthermore, in an aspect of the valve driving device of the present invention, a torque-reducing mechanism that reduces driving torque generated in driving respective valves in the group of cylinders may be employed in common to the group of cylinders. When an electric motor is shared in the cylinders of a group of cylinders, respective torque appeared as rotation resistances of an electric motor in driving valves of respective cylinders may be reduced all together by a common torque-reducing mechanism. Thus, the sharing of a torque-reducing mechanism prevents the valve driving device from growing in size, and relaxes the restriction of mounting the valve driving device on a vehicle.

The motion-transmission mechanism may be provided with a transmission shaft that connects the rotating bodies of the motion-transmission device in the group of cylinders with each other, and the electric motor may be connected to the motion-transmission shaft so as to transmit the rotational motion to the motion-transmission shaft. According to this configuration, rotational motion can be uniformly transmitted to respective motion-transmission devices of a plurality of cylinders by connecting the electric motor to the motion-transmission shaft.

In the present invention, the internal combustion engine maybe configured as an even interval firing, in-line four-cylinder four-stroke-cycle internal combustion engine in which the firing interval between the outer pair of the cylinders is set to 360 deg. in terms of a crank angle in the order of firings at the cylinders. In this case, the valve driving device according to an aspect of the present invention is accomplished by providing as the electric motor with a first electric motor shared in the motion-converting devices in a first group of cylinders consisting of the outer pair of cylinders and a second electric motor shared in the motion-converting devices in a second group of cylinders consisting of the inner pair of cylinders, and providing as the motion-transmission mechanism a first motion-transmission mechanism that transmits rotational motion of the first electric motor to the rotating bodies of respective motion-converting devices in the first group of cylinders and a second motion-transmission mechanism that transmits rotational motion of the second electric motor to the rotating bodies of respective motion-converting devices in the second group of cylinders. It is noted that, in this configuration, "four-stroke-cycle" means an operation in which four strokes of intake, compression, power, and exhaust occur in sequentially while the crank rotates two turns. Even if a cycle is switchable to a two-stroke cycle, where the four strokes occur in one turn of the crankshaft, through the control of operating characteristics of the valve, the cycle is still categorized as a four-stroke-cycle as long as the cycle includes a case when the four-stroke-cycle operation is performed.

Further in the above aspect, the first motion-transmission mechanism may be equipped with a first motion-transmission shaft that connects the rotating bodies of respective motion-converting devices in the first group of cylinders, and the second motion-transmission mechanism may be equipped with a second motion-transmission shaft that connects the rotating bodies of respective motion-converting devices in the second group of cylinders. The second motion-transmission shaft may be coaxially positioned outside the first motion-transmission shaft, and the first electric motor may be connected to the first motion-transmission shaft so as to transmit the rotational motion to the first motion-transmission shaft, and the second electric motor may be connected to the second motion-transmission shaft so as to transmit the rotational motion to the second motion-transmission shaft. According to this configuration, even though the cylinders in the first group of cylinders are separated from each other by the second group of cylinders, the rotational motion of the first electric motor can be transmitted to the motion-converting devices of respective cylinders in the first group of cylinders. The rotational motion can be also transmitted to the second group of cylinders by connecting the electric motor to the periphery of the second group of cylinders.

In an aspect of the present invention, the internal combustion engine may be configured as an even interval firing, six-cylinder, four-stroke cycle internal combustion engine. In this case, a group of cylinders may be configured from the cylinders in which the firing timings between respective cylinders are set to 360 deg. in terms of a crank angle in the order of firings at the cylinders, and the electric motor and the transmission mechanism may be provided to each cylinder. According to this configuration, the invention is accomplished by providing sufficient closing time for all valves between the opening periods of respective valves in one group of cylinders. However, in some working angles of valves, at least two cylinders apart by a firing interval of less than 360 deg. in terms of a crank angle may be included in one group of cylinders. The meaning of four-stroke cycles is the same as describe above.

In an aspect of the valve driving device of the present invention, a cam mechanism may be, for example, employed as a motion-converting device, and a cam in the cam mechanism may be treated as an equivalent to the rotating body in the motion-converting device. Namely, the valve driving device can be configured by operating the cams which operate valves and are provided for each cylinder having the open-valve periods not overlapped each other by an electric motor.

In an aspect of the present invention, the valve driving device may further include a control device that controls operating characteristics of respective valves in the group of cylinders by varying at least one of rotation speed and rotation direction of the electric motor. In the case that electric motors are employed as valve-driving sources to respective valves in each of a plurality of groups of cylinders each of which consists of a plurality of cylinders, respectively, in which the open-valve periods do not overlap, the control device may control respective valves in the groups of cylinders by varying at least one of the rotation speed or direction of each electric motor.

Further in the above aspect, the valve driving device may include a cam mechanism that converts rotational motion outputted from the electric motor into linear motion of the valves, and the control device may control the electric motor to rotate cams of the cam mechanism rotate continuously in the same direction with a varying rotation speed such that the rotation speed of a cam driving a valve is at the maximum or at the minimum when lift amount of the respective valve is at the maximum. In this case, the working angle of the valve can be varied by changing the rotation speed. Further, in varying the lift amount of the valve obtained by changing the working angle, an adjustable range of the working angle can be maximized by controlling the variation of rotation speed to maximize or minimize the rotation speed when the lift amount is the maximum. When a plurality of electric motors is employed to each of a plurality of groups of cylinders, the control device preferably controls one of the electric motors as described above.

Furthermore, in the above aspect, the valve driving device may include cam mechanisms that convert rotational motion outputted from the electric motor into linear motion of the valves, and each of the groups of cylinders may consist of two cylinders, and the control device may drive the electric motor such that the electric motor swings in opposite two directions within a range between a position where maximum lift amount is given by a cam in the cam mechanism of a cylinder in a group of cylinders and a position where maximum lift amount is given by a cam in the cam mechanism of another cylinder in the same group of cylinders, while varying the amount of swings. According to the configuration, through the swings of the cam, the peak lift amount of the valve in each cylinder can be controlled equal to or less than the maximum lift amount given by the cam. The peak lift amount can be continuously varied by varying the swing amount of the electric motor. Further, when a plurality of electric motors is employed to each of a plurality of groups of cylinders, and each group of cylinders has 2 cylinders, the control device preferably controls each electric motor as described above.

In the above aspect, the control device may further vary the rotation speed of the electric motor during the swing. The working angle of the valve can be continuously varied by varying the rotation speed during the swing. Accordingly, the intake valve is provided with an operating characteristic of reducing the intake amount by reducing the lift amount and the working angle in the control of the intake valve, thus pumping loss can be reduced by opening an intake throttle such as a throttle valve. When a plurality of electric motors is employed to a plurality of groups of cylinders, the control device can further vary the rotation speed of the electric motors in the swing.

Furthermore, in swing control, the control device may control the electric motor to use both sides of the head of the nose portion of the cam in the group of cylinders alternately in driving the valve. In the swing control, the valve in each cylinder can be opened and closed by using only one side of the head of a cam nose portion; however, lubrication or wear tends to be biased in the used side. Alternatively, when both sides are alternately used for operating, the bias of lubrication or the wear can be prevented. Further, the 'alternately' refers to operate the valve using both sides one after the other at predetermined period, and is not limited to the case both sides are used every opening and closing of the cam one after the other. The change of period depends on parameters such as time and the number of swings. When a plurality of electric motors is employed to a plurality of groups of cylinders, the control device may control the electric motors such that the cam for each group of cylinders is used as described above.

In an aspect of the valve driving device of the present invention, the control device may swing the electric motor in opposite two directions, such that a valve of a cylinder in a group of cylinders opens and closes and a valve of the other cylinder in the same group of cylinders remains closed in a reduced cylinder operation of the internal combustion engine. Through the swing of the electric motor within the above range, the reduced cylinder operation is accomplished by combusting in one cylinder while stopping the combustion in the other cylinder. In this case, a mechanical valve stopper is not required, thus the valve driving device can be simple.

Furthermore, in the configuration in which an electric motor is employed to each of the plurality group of cylinders as a valve-driving source, the control device may stop a part of the electric motors at the position where all valves driven by each of the motors are closed in a reduced cylinder operation of the internal combustion engine. Since the open-valve periods of respective cylinders do not overlap in the same group of cylinders, combustions can be stopped in all the cylinders in the same group of cylinders by stopping the electric motor at an appropriate position within a range where valves of all the cylinders are closed. The reduced cylinder operation is accomplished by controlling the part of electric motors as described above while controlling other electric motors to open and close the respective valves.

Further in the above aspect, the control device may control each of the electric motors such that the number of the cylinders with their valves closed is lower than the total number of cylinders in a reduced cylinder operation of the internal combustion engine. As described above relating to the above-mentioned configuration, it is possible to stop combustion in one or more cylinders in the same group of cylinders by swinging the electric motor in the opposite two directions or stopping it. The operating condition can be flexibly controlled in the reduced cylinder operation in the internal combustion engine by adjusting the control of stopping combustion and varying the number of the non-combusting cylinder under total number of the cylinders.

Further in the above aspect, the control device may control each of the electric motors such that the number of the cylinders with their valves closed is lower than the total number of cylinders and at least one of the lift amount and working angle of a cylinder is varied in the cylinder in which the valve opens and closes in a reduced cylinder operation of the internal combustion engine. In this case, by varying the number of the non-combusting cylinder less than the total number of the cylinders and the lift amount or the working angle of the valve in the combusting cylinder, the intake or exhaust efficiency in the cylinders is varied and the operating condition of the internal combustion engine can be flexibly controlled. For example, the pumping loss and engine brake force are minutely controlled by varying the lift amount of the intake valve and working angle of the valve.

BRIEF DESCRIPTION OF THE DRAWINGS

FIG. 8 is a diagram showing variation of operating characteristics that can be realized by the valve driving device of FIG. 1.

BEST MODE FOR CARRYING OUT THE INVENTION

Figure 1:
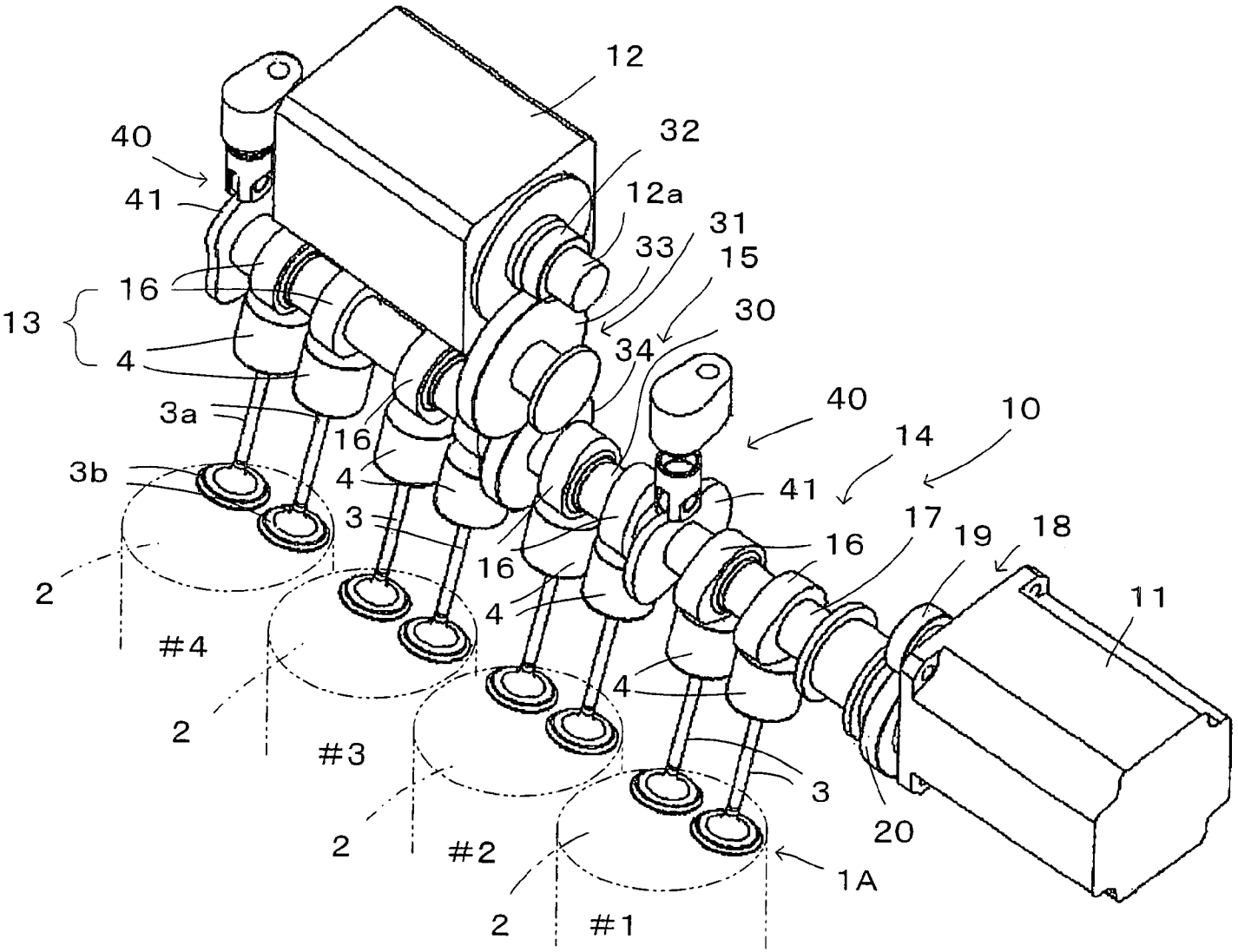
FIG. 1 is a perspective view showing an embodiment of a valve driving device according to the present invention.

FIG. 1 shows an embodiment in which a valve driving device is applied to a reciprocating four-stroke-cycle internal combustion engine. The internal combustion engine 1A is an in-line four-cylinder type engine having four cylinders 2 arranged in a line. In FIG. 1, each of the cylinders 2 is distinct from each other by numbering them #1 to #4 from one end to the other end of their arranged line. Typically, in the four-stroke-cycle, in-line four-cylinder internal combustion engine 1A, a firing interval between the outer pair of the #1 and #4 cylinders 2 is set to 360 deg.CA (hereinafter, 'deg.CA' denotes a crank angle) and the firing timings of the inner pair of the #2 and #3 cylinders 2 are delayed by 180 deg.CA and 540 deg.CA, respectively, from the firing timing of the #1 cylinder 2. Thus, an even interval firing is realized at an interval of 180 deg.CA. It is noted that the order of the firing timings between the #2 and #3 cylinders 2 can be freely altered. Hereinafter, it is assumed that the firing timing of the #3 cylinder 2 is prior to that of the # 2 cylinder 2. Thus, the firing sequence of the cylinders 2 of the internal combustion engine 1A is set as #1→#3→#4→#2.

Figure 4:
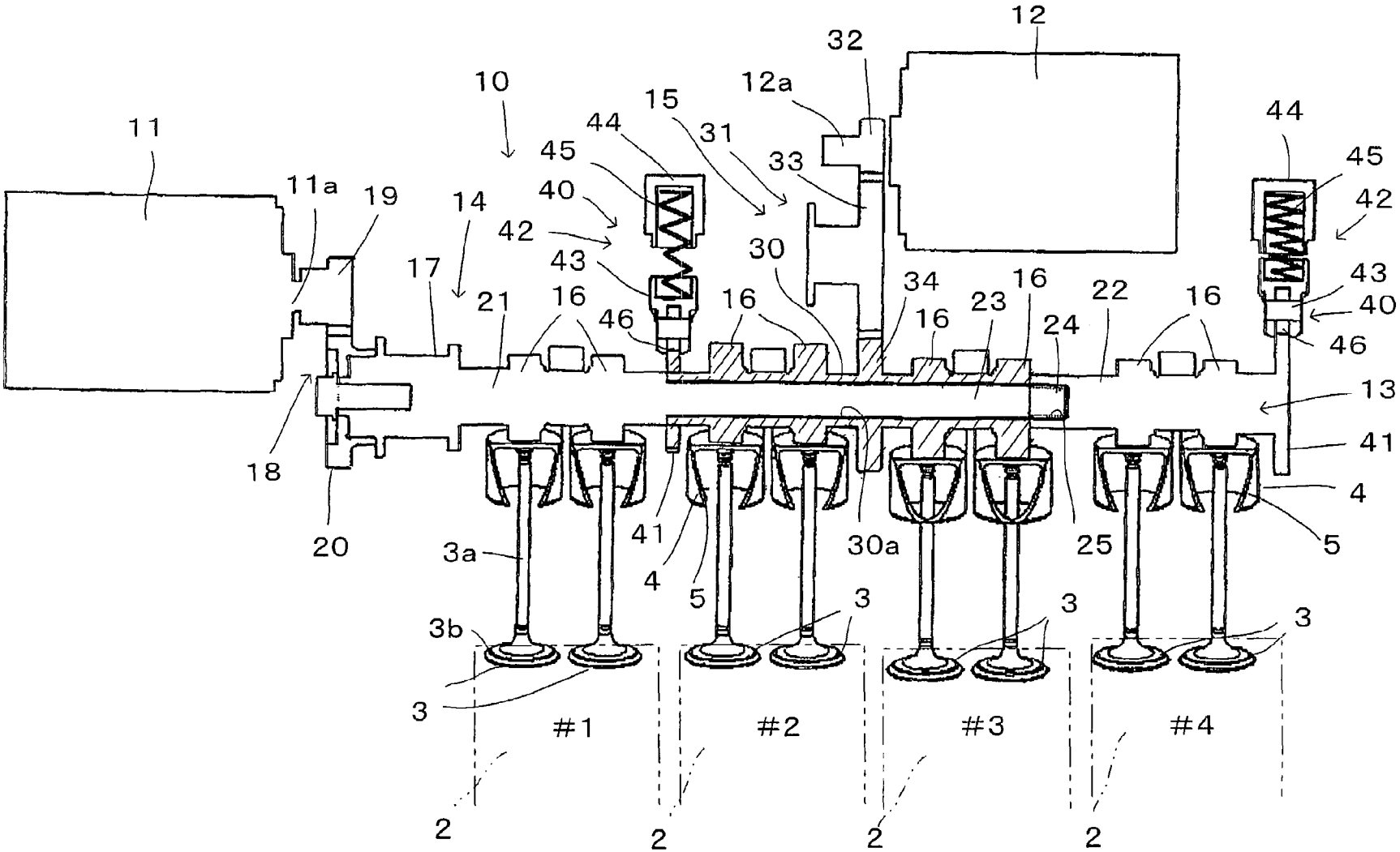
FIG. 4 is a cross-sectional view of the valve driving device in FIG. 1.

Each of the cylinders 2 is provided with two intake valves 3. Here, exhaust valves are not shown. The intake valve 3 opens and closes by a valve driving device 10. As is well known in the art, the intake valve 3 is provided reciprocal-movably in the axial direction of a stem 3*a* of the intake valve with the stem 3*a* passing through a valve stem guide of a cylinder head (not shown). As shown in FIG. 4, a valve lifter 4 is fitted integrally and reciprocal-movably to the top end of the intake valve 3. A valve spring 5 is mounted between the valve lifter 4 and the cylinder head. The intake valve 3 is urged by the repulsive force against the compression of the valve spring 5 in the direction that a valve face 3*b* gets closely contacted with a valve seat of an intake port (in a direction of closing the valve). The valve driving device 10 drives the intake valve 3 in the direction of opening the valve against the force of the valve spring.

Figure 2A:
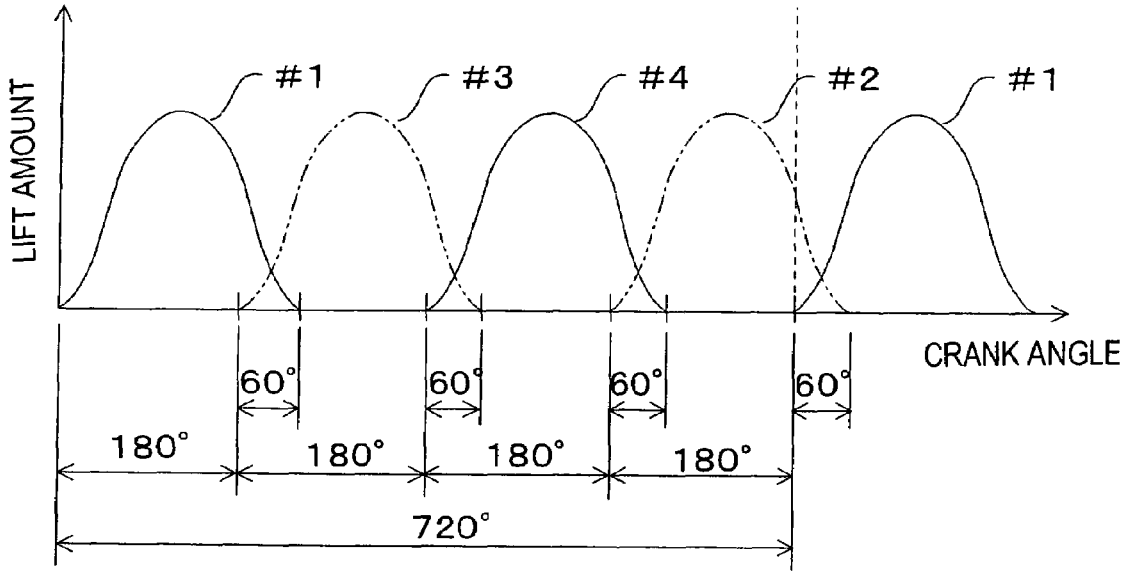
FIG. 2A is a diagram showing a relationship between a crank angle and open-valve periods of respective cylinders in an internal combustion engine to which the present invention is applied.
Figure 2B:
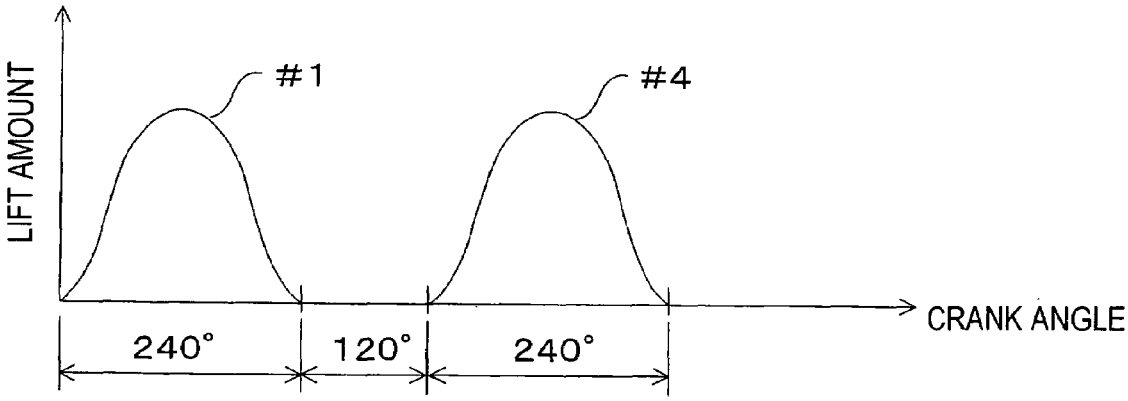
FIG. 2B is a diagram showing a relationship between a crank angle and open-valve times in a first group of cylinders in which the open-valve periods do not overlap.
Figure 2C:
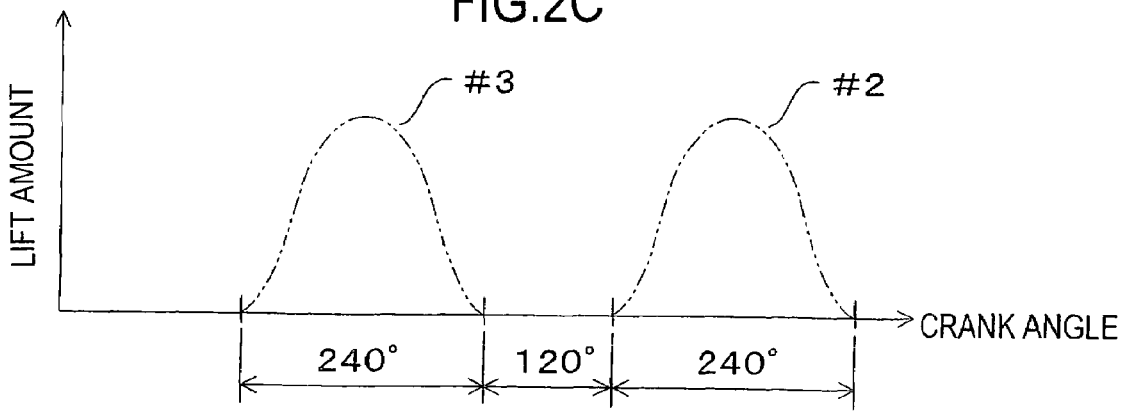
FIG. 2C is a diagram showing a relationship between a crank angle and open-valve times in a second group of cylinders in which the open-valve periods do not overlap.

FIG. 2A shows relationships between a crank angle and lift amounts of the intake valves 3 of respective cylinders 2 (the lift amount is a displacement in the direction of opening a valve relative to the closed position thereof). A working angle of each intake valve 3 (the working angle expresses an open-valve period in terms of the crank angle) is tuned up appropriately depending on the specification of the internal combustion engine 1A. Further, the working angle varies in response to the operating state of the internal combustion engine 1A in a valve driving device having a variable valve-driving mechanism. Typically, the working angle of the intake valve 3 is set to 240 deg.CA. In this setting of the working angle, the open-valve periods of intake valves do not overlap with each other between the outer pair of the #1 and #4 cylinders as shown in FIG. 2B, and the open-valve periods of intake valves do not overlap with each other between the inner pair of the #2 and #3 cylinders as shown in FIG. 2C. Accordingly, as shown in FIG. 1, in the valve driving device 10 of the present embodiment, the cylinders are classified into a first group of cylinders consisting of the outer pair of cylinders 2 and a second group of cylinders consisting of the inner pair of cylinders 2. A first electric motor 11 and a second electric motor 12 are provided as a valve-driving source to each of the groups of cylinders, respectively.

Figure 3:
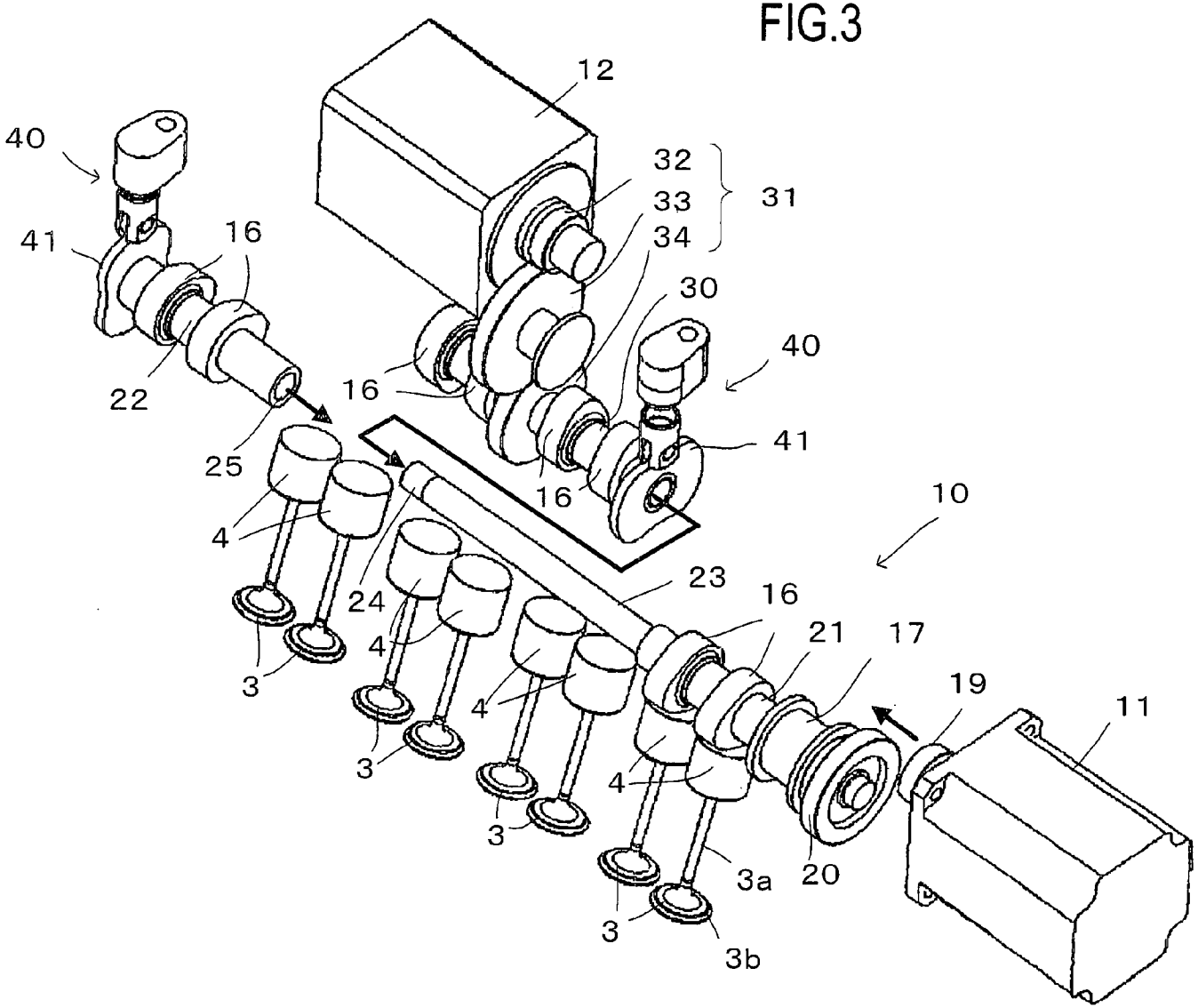
FIG. 3 is an exploded perspective view of the valve driving device in FIG. 1.
Figure 5:
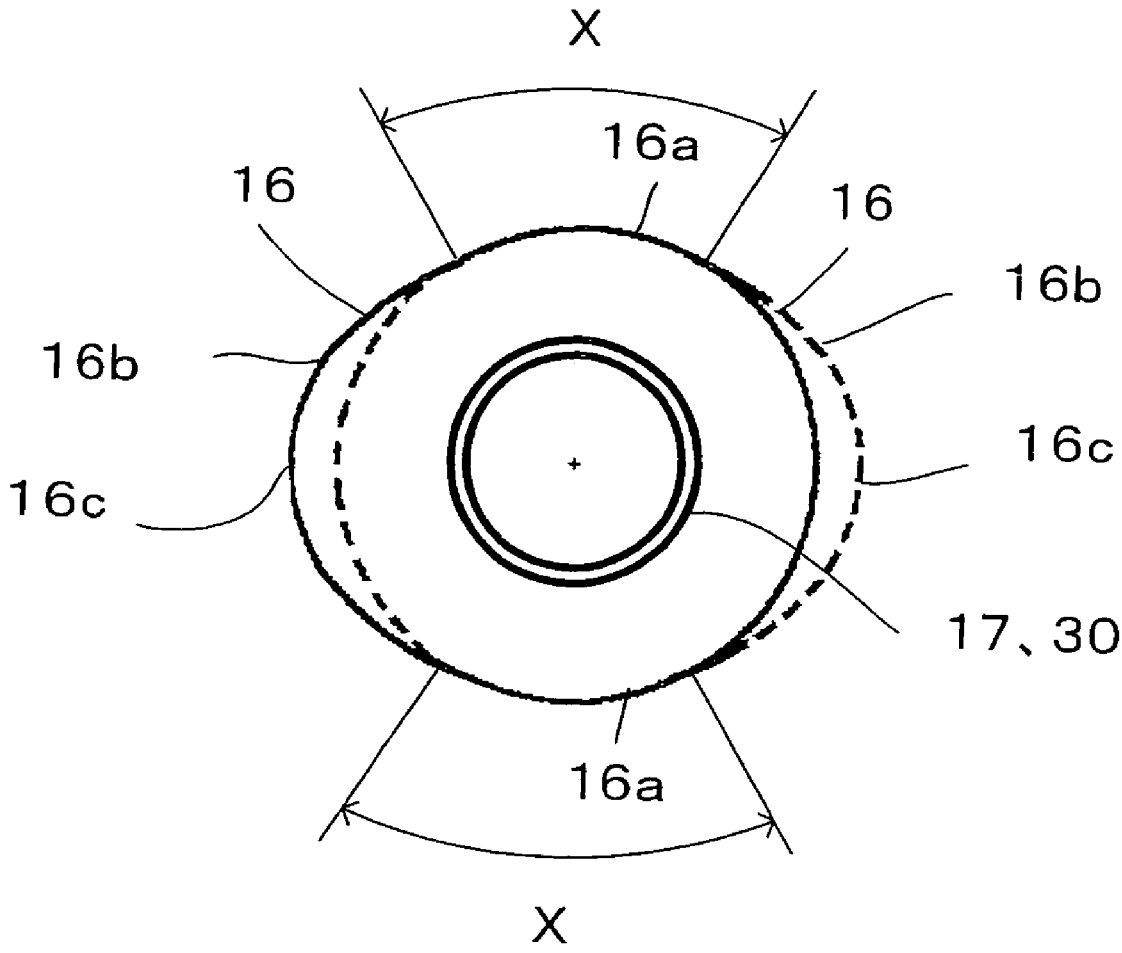
FIG. 5 is a view showing cams in the same group of cylinders in an overlapped manner.

FIGS. 3 and 4 show the valve driving device 10 in detail. As shown in these figures, in addition to the above mentioned electric motors 11 and 12, the valve driving device 10 includes cam mechanisms 13 each of which serves as a motion-converting device provided to each intake valve 3, and first and second motion-transmission mechanisms 14 and 15 that transmit rotations of the electric motors 11 and 12 to the cam mechanisms 13 of each group of cylinders corresponding to the motor, respectively. All the cam mechanisms 13 have the same configuration. The cam mechanism 13 has a cam 16 as a rotating body, and drives the intake valve 3 in the direction of opening the valve by pushing down the valve lifter 4 provided to the top end of the intake valve 3 with the cam 16. Namely, the valve lifter 4 functions as a follower for the cam 16. As shown in FIG. 5, a profile of the cam 16 is set to a well known shape in which a nose portion 16*b* is provided by partially expanding a base circle 16*a*. The valve lifter 4 is pushed down by the nose portion 16*b*.

The first motion-transmission mechanism 14 includes a cam shaft 17 (a first transmission shaft) that connects respective cams 16 of the outer #1 and #4 cylinders with each other and a speed reducer 18 transmitting the rotation of the electric motor 11 to the cam shaft 17. The speed reducer 18 includes a motor gear 19 fitted to the output shaft 11*a* of the electric motor 11, and a driven gear 20 that is fixed to one end of the cam shaft 17 so as to be integrally rotated and is meshed with the motor gear 19. The cam shaft 17 has an interconnecting structure in which a first shaft member 21 that drives the cams 16 of the #1 cylinder and a second shaft member 22 that drives the cams 16 of the #4 cylinder are combined. A shaft-connecting portion 23 is formed coaxially and integrally on the first shaft member 21, and the shaft-connecting portion 23 extends to the #4 cylinder with passing over the #2 and #3 cylinders. Both shaft members 21 and 22 are connected coaxially with fitting the shaft-connecting portion 24 of an end of the shaft-connecting portion 23 into the shaft-connecting hole 25 of the second shaft member 22 coaxially. A means for stopping rotation, such as a spline, is formed between the shaft-connecting portion 24 and the shaft-connecting hole 25. Accordingly, the first and the second shaft members 21 and 22 are connected so as to be integrally rotated. The shaft-connecting portion 23 has a diameter smaller than those of the first and the second shaft members 21 and 22. Although the cams 16 are integrally formed on the first and the second shaft members 21 and 22, the cams 16 can be formed as separate parts from the shaft members 21 and 22 and be fitted to the shaft members 21 and 22 with a fitting means, such as a press fitting or a thermal fitting.

On the other hand, the second transmitting mechanism 15 includes a cam shaft 30 (a second transmission shaft) connecting respective cams 16 of the inner #2 and #3 cylinders with each other, and a speed reducer 31 transmitting rotation of the electric motor 12 to the cam shaft 30. The speed reducer 31 includes a motor gear 32 fitted to the output shaft 12*a* of the electric motor 12, an intermediate gear 33 meshed with the motor gear 32, and a driven gear 34 fixed to the middle-portion of the cam shaft 30 so as to be integrally rotated and is meshed with the intermediate gear 33. The cam shaft 30 is constructed in the form of a tubular shaft with a through hole

30*a* extending in the axial direction, and cams 16 are integrally formed on the periphery of the cam shaft. The shaft-connecting portion 23 of the cam shaft 17 is rotatably inserted in the through hole 30*a* of the cam shaft 30. Accordingly, the cam shaft 30 is arranged rotatably and coaxially around the periphery of the cam shaft 17. Further, the cam shaft 30 has the same diameter as those of the first and second shaft members 21 and 22 of the cam shaft 17. The cams 16 can be formed as separate parts from the cam shaft 30 and be fitted to the cam shaft 30 with a fitting means, such as a press fitting or a thermal fitting. The driven gear 34 is configured in the same manner.

The cams 16 of one cylinder of #1 or #3 in the same group of cylinders and the cams 16 of another cylinder of #4 or #2 in the other group are connected to the cam shaft 17 or 30, respectively, such that heads 16*c* of their cam nose portions 16*b* are shifted relative to each other in the peripheral direction by 180 deg. The cams 16 are thus configured, since the open-valve periods of intake valves 3 are shifted by 360 deg.CA between these two cylinders. Accordingly, regions X appear in the peripheral direction of each cam shaft 17 and 30 as shown clearly in FIG. 5, where the nose portions 16*b* of cams 16 do not overlap with each other. It is noted that the diameter of the base circle 16*a* is set such that a suitable clearance (a valve clearance) exists between the valve lifter 4 and the cam 16. Furthermore, the cam mechanism 13 can be provided in a crankcase and linear motion obtained from the cam mechanism to the intake valve 3 through a motion-transmission part, such as a push rod. The internal combustion engine is not limited to an OHC type, and may be an OHV type.

Figure 6:
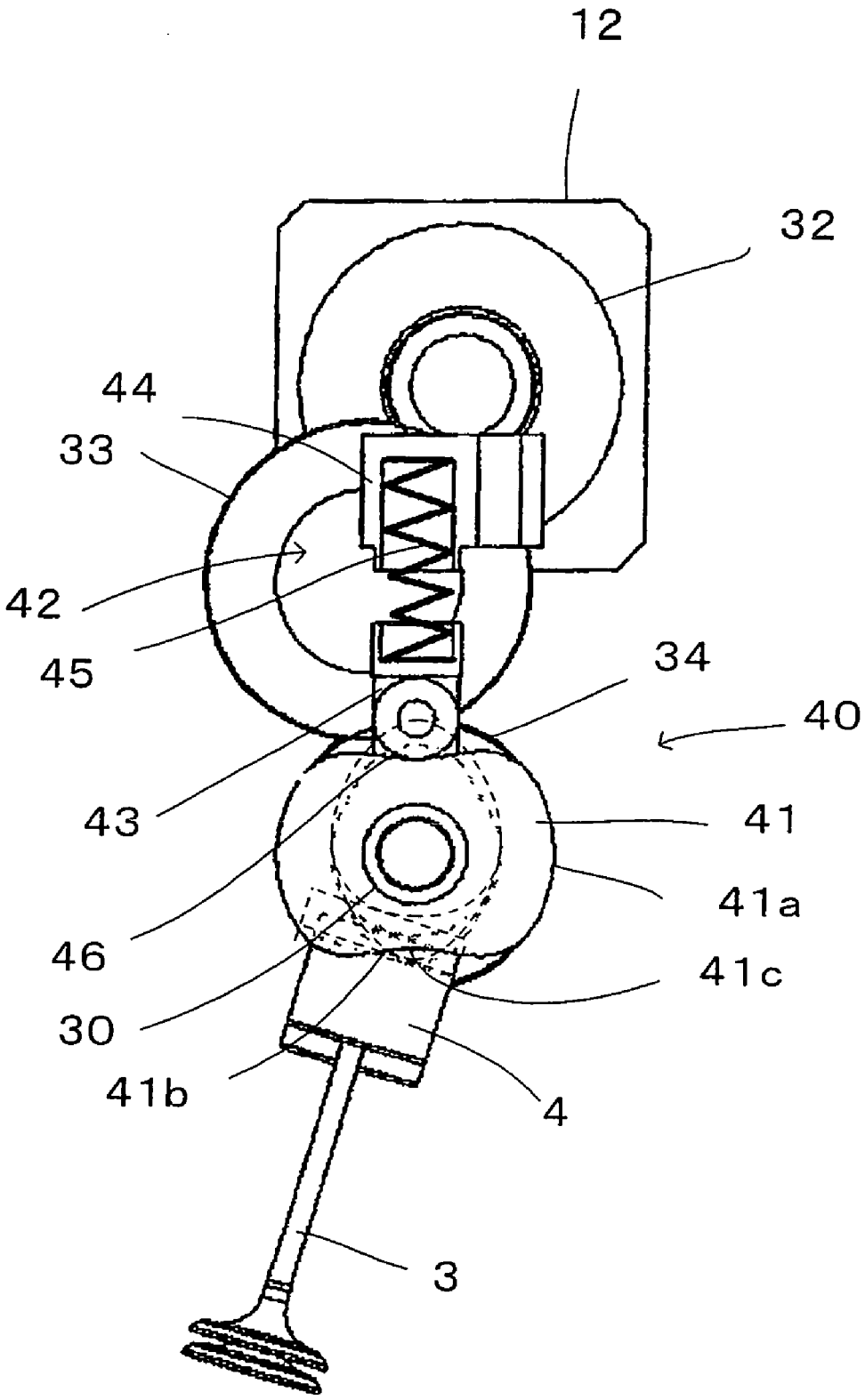
FIG. 6 is a view showing a torque-reducing mechanism.
Figure 7:
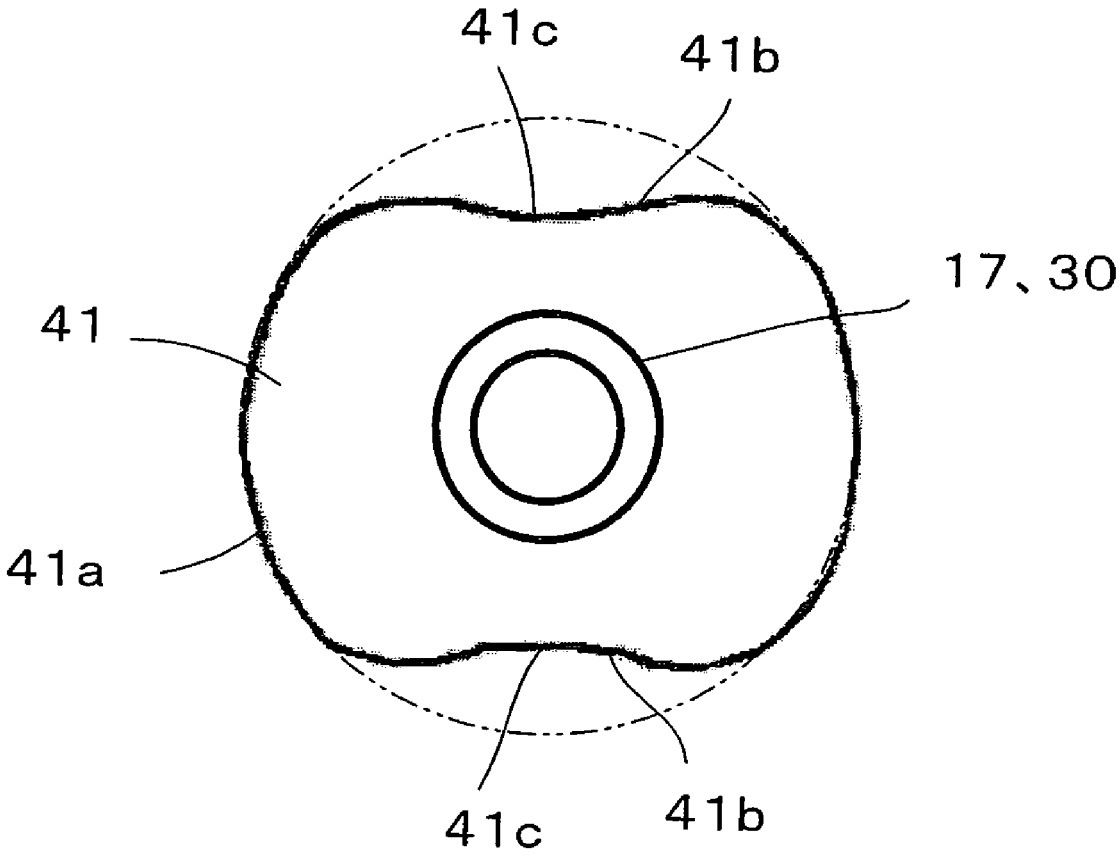
FIG. 7 is a view showing an opposite-phase cam in the torque-reducing mechanism.

Each of the motion-transmission mechanisms 14 and 15 is equipped with a torque-reducing mechanism 40. As shown in FIG. 6 in detail, the torque-reducing mechanism 40 includes an opposite-phase cam 41 and a torque-exerting unit 42 that exerts a load caused by friction on the periphery of the opposite-phase cam 41. It is noted that the torque-reducing mechanism 40 for the #2 and #3 cylinders is shown in FIG. 6. Furthermore, the torque-reducing mechanism 40 for the #1 and #4 cylinders also has the same configuration. The opposite-phase cams 41 are fitted to an end of the second shaft member 22 of the cam shaft 17 and an end of the cam shaft 30, respectively, so as to be integrally rotated. The opposite-phase cams 41 may be integrally formed on the shafts 17 and 30. Furthermore, the opposite-phase cams 41 may be formed as a separate part and be fitted to the shafts 17 and 30 with a fitting means, such as a press fitting or a thermal fitting. The periphery face of the opposite-phase cam 41 is configured as a cam face. The profile of the cam face is configured to have a pair of recesses 41*b* in part of the base circle 41*a* as shown in FIG. 7. The recesses 41*b* are provided such that the bottoms 41*c* of the recesses 41*b* are separated relative to each other by 180 deg. in the peripheral direction.

Returning to FIG. 6, the torque-exerting unit 42 includes a lifter 43 disposed to face the periphery of the opposite-phase cam 41, a retainer 44 disposed outside the lifter 43, and a coil spring 45 that is mounted between the lifter 43 and the retainer 44 and urges the lifter 43 toward the opposite-phase cam 41. A roller 46 is rotatably fitted to an end of the lifter 43. The roller 46 is pressed against the periphery of the opposite-phase cam 41 with the repulsive force of the coil spring 45.

The lifter 43 corresponding to the opposite-phase cam 41 of the cam shaft 17 is positioned with respect to the periphery direction of the cam shaft 17, such that the head 16*c* of the nose portion 16*b* of the cam 16 for the #1 cylinder fitted to the cam shaft 17 comes in contact with the valve lifter 4 for the #1 cylinder when the roller 46 comes in contact with the bottom 41*c* of one of the recesses 41*b* provided on the opposite-phase cam 41 and the head 16*c* of the nose portion 16*b* of the cam 16 for the #4 cylinder fitted on the shaft 17 comes in contact with the bottom 41*c* of the other recess 41*b* provided on the valve lifter 4 for the #3 cylinder when the roller 46 comes in contact with the bottom 41*c* of the other recess 41*b*. Furthermore, the lifter 43 corresponding to the opposite-phase cam 41 of the shaft 30 is positioned with respect to the periphery direction of the cam shaft 17, such that the head 16*c* of the nose 16*b* of the cam 16 for the #3 cylinder fitted to the shaft 30 comes in contact with the valve lifter 4 for the #3 cylinder when the roller 46 comes in contact with the bottom 41*c* of one of the recess 41*b* provided on the opposite-phase cam 41 and the head 16*c* of the nose portion 16*b* of the cam 16 for the #2 cylinder fitted to the shaft 30 comes in contact with the bottom 41*c* of the other recess 41*b* provided on the valve lifter 4 for the #2 cylinder when the roller 46 comes in contact with the bottom 41*c* of the other recess 41*b*.

According to the valve driving device 10 configured as described above, the intake valve 3 opens and closes in sync with the rotation of a crankshaft by driving the cam shafts 17 and 30 with the electric motors 11 and 12, respectively, to rotate continuously in one direction at a half speed (hereinafter, referred to as a standard speed) of the rotation speed of the crankshaft of the internal combustion engine 1A. This operation is similar to that of a typical mechanical valve driving device that drives valves with power from a crankshaft.

Furthermore, according to the valve driving device 10, the operating characteristics of the intake valve 3 vary in various ways, as shown in items A to G of FIG. 8, in response to changes in a relative relationships between the crank angle and the phase of the cam 16 by varying the rotation speeds of the cam shafts 17 and 30 relative to their standard speeds with the electric motors 11 and 12. In FIG. 8, the 'lift shape' in a solid line represents operating characteristics of the intake valve 3 when the cam shafts 17 and 30 rotate continuously at the standard speed, and the 'lift shape' in a virtual line represents altered operating characteristics of the intake valve 3 realized through a speed control of the motors 11 and 12. The abscissa and ordinate of the lift shape represent the crank angle and the lift amount, respectively.

First, the variation in the operating characteristic shown in the item A of FIG. 8 is realized by accelerating or slowing down the rotations of the cam shafts 17 and 30 relative to their standard speeds while the intake valve 3 is closed so as to vary the relative relationships between the crank angle and the phase of the cam 16. The working angle varies as shown in the item C of FIG. 8, when the rotations of the cam shafts 17 and 30 are accelerated or slowed down relative to their standard speeds while the intake valve 3 is open.

The item B of FIG. 8 shows an example in which the lift amount of the intake valve 3 is restricted less than the maximum lift amount, that is, the lift amount of the intake valve 3 realized when the head 16*c* of the nose portion 16*b* is in contact with the valve lifter 4. Such variation of the lift amount is realized by stopping the electric motors 11 and 12 and then rotating them in the opposite direction while the cam 16 is opening the intake valve 3. In this case, the intake valve 3 is pressed to be opened by a forward rotational drive of the cam 16, whereas the intake valve 3 gets back in the direction of closing the valve with the reverse rotational drive of the cam 16 starting before the head 16*c* of the nose portion 16*b* comes in contact with the valve lifter 4. Since the working angle of the intake valve 3 may be varied appropriately with the forward and reverse rotational drives of the motors 11 and 12, only the lift amount may be varied without changing the working angle, as shown in the item D of FIG. 8.

The Item E of FIG. 8 shows an example in which a lift speed varies while the working angle of the intake valve 3 is maintained by rotating the cam shafts 17 and 30 continuously in one direction and accelerating their rotation speeds while the intake valve 3 opens, and slowing down the rotation speeds of the cam shafts 17 and 30 while the intake valve 3 closes so as to cancel a phase shift between the crank angle and the cam 16 caused by the acceleration. Given the operating characteristic shown in the item E of FIG. 8, the intake efficiency is improved by quickly opening the intake valve 3, and the shock generated when the intake valve 3 comes in contact with a valve seat may be moderated by slowing down the lift speed in closing the valve 3.

The item F of FIG. 8 shows an example in which the operating cycle of the internal combustion engine 1A is altered from a four-stroke-cycle to a two-stroke-cycle by opening and closing the intake valve 3 in separate two sets during a period in which the intake valve 3 is to be opened and closed once, with driving the cam shafts 17 and 30 to rotate at two times the standard speed, that is, at the same rotation speed as the crankshaft. Furthermore, the item G of FIG. 8 is an example in which the intake valve 3 opens at an earlier timing accordingly when the internal combustion engine 1A is operated in stratified combustion. However, the lift amount remains small for a certain time after the intake valve 3 starts opening. These operating characteristics are accomplished such that after advancing the opening timing of the intake valve 3 with accelerating the cam shafts 17 and 30 over the standard speed during that the intake valve 2 is closed, the increase of the lift amount is suppressed by slowing down the rotation speed of the cam shafts 17 and 30 to a considerably low speed or stopping the cam shafts 17 and 30 temporarily, and the lift amount is increased by accelerating the cam shafts 17 and 30 after maintaining the above conditions for a predetermined time. Furthermore, the item H of FIG. 8 is an example in which the cam shafts 17 and 30 stop so as to keep the intake valve 3 closed. The intake valve 3 can be kept in an open state by stopping the cam shafts 17 and 30 while the nose portion 16*b* pushes toward the valve lifter 4.

As described above, according to the valve driving device 10 of the present invention, the intake valve 3 may have various operating characteristics through the speed controls of the cam shafts 17 and 30 by the electric motors 11 and 12. In addition, since the regions X where the nose portions 16*b* do not overlap are provided on the periphery of the cam shafts 17 and 30 as described above, the open-valve periods of intake valves 3 in the #1 and #4 cylinders operated by the electric motor 11 do not overlap. Similarly, the open-valve periods of intake valves 3 in the #2 and #3 cylinders operated by the motor 12 do not overlap. Accordingly, even if a relative relationship between a crank angle and a phase of the cam 16 differs from the relationship in the case of driving the cam shafts 17 and 30 continuously at the standard speed, for example, as a result of varying the operating characteristic of an intake valve 3 of either one of the cylinder of #1 or #4 with the speed control of the electric motor 11, by adjusting the speed of the electric motor 11 to cancel the above difference in the relative relationship while the region X of the cam shaft 17 faces the valve lifter 4, that is, all base circles 16*a* of the cams 16 on the cam shafts 17 of the #1 and #4 cylinders pass through the valve lifter 4, the variation of the operating characteristic of the intake valve 3 in one of the cylinders does not affect the operating characteristic of the intake valve 3 in the other cylinder, which thus may be controlled arbitrary. Similarly, the same procedure is also applicable to the #2 and #3 cylinders.

It is noted that since the above regions X do not exist and the open-valve period of each intake valve 3 necessarily overlaps the open-valve period of another intake valve 3 in the case of driving all the cams 16 of the cylinders 2 with one shared electric motor, the working angle of each of the intake valves 3 cannot be altered, and also the cam shafts 17 and 30 cannot be rotated in the opposite direction. Accordingly, in the items other than A and E of FIG. 8, the above-mentioned advantages are not achievable. Furthermore, according to the valve driving device 10, a great variety of operating-characteristics are obtainable as compared with when the intake valves 3 of all the cylinders 2 are driven by a same electric motor. Further, the valve driving device 10 can be reduced in size and has an advantage in cost due to the decreased number of parts involved, since fewer motors are required as compared with the case in which an electric motor is employed for each cylinder.

Figure 9:
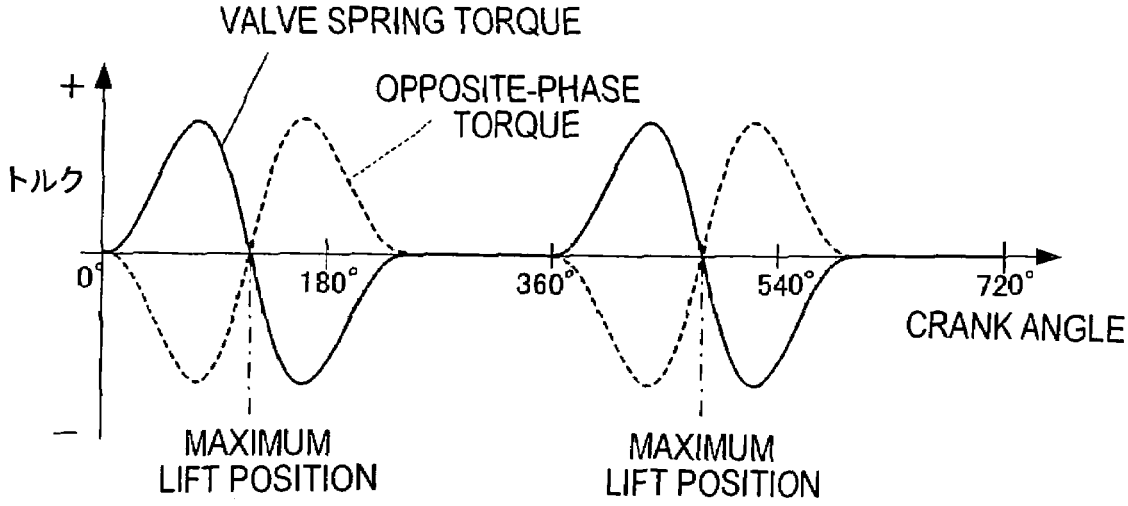
FIG. 9 is a diagram showing relationships of a valve spring torque applied by a valve spring and an opposite-phase torque applied by the torque-reducing mechanism to a crank angle.

In the valve driving device 10 according to the embodiment, the torque-reducing mechanism 40 is employed for each of the motion-transmission-mechanisms 14 and 15, thus, the rated torque required for the electric motors 11 and 12 may be reduced by reducing the drive torque exerting on the electric motors 11 and 12, thereby achieving reduced-sized electric motors 11 and 12 and a more compact valve driving device 10. FIG. 9 shows a relationship between the valve spring torque (a solid line) urged by the valve spring 5 toward the cam shaft 17 or 30, the counter torque (a broken line) urged by the torque-reducing mechanism 40 toward the cam shaft 17 or 30, and the crank angle. The abscissa represents torque=0, a torque urged in the direction opposing to the forward rotation of the cam 16 is designated by the positive sign (+) and the torque urged in the direction of the forward rotation of the cam 16 is designated by the negative sign (−). FIG. 9 shows an example in which the cam shafts 17 and 30 are driven continuously in a forward direction at the standard speed.

As shown with a solid line in FIG. 9, the valve spring torque is approximately 0 where the cam 16 allows the intake valve 3 to be positioned at the maximum lift amount. Since the repulsive force of the valve spring 5 exerts to push back the cam 16 in the opposite rotation direction, the valve spring torque is positive before reaching the maximum lift amount, that is, in the course of opening the intake valve 3. Since the repulsive force of the valve spring 5 exerts to push forward the cam 16 in the forward rotation direction, the valve spring torque is negative after reaching the maximum lift amount, that is, in the course of closing the intake valve 3. On the other hand, as shown with a broken line in FIG. 9, the opposite-phase torque is approximately 0 at a position of the maximum lift amount position, is negative before reaching the maximum lift amount position, and is positive after reaching the maximum lift amount position. In the course of opening the intake valve 3, the lifter 43 advances in the recess 41*b* toward the bottom 41*c* and the repulsive force of the coil spring 45 exerts on the opposite-phase cam 41 through the lifter 43 to drive the opposite-phase cam 41 in a forward rotation direction, whereas in the course of closing the intake valve 3, the lifter 43 advances in the recess 41*b* away from the bottom 41*c* and the repulsive force of the coil spring 45 exerts on the opposite-phase cam 41 through the lifter 43 to push the opposite-phase cam 41 back in the opposite rotation direction.

Accordingly, the valve spring torque exerted from the cam 16 side to the cam shafts 17 and 30, that is, the torque exerted from the valve spring 5 to the cam shafts 17 and 30 through the valve lifter 4 and the cam 16, and the opposite-phase torque exerted from the opposite-phase cam 41 side to the cam shafts 17 and 30, that is, the opposite-phase torque exerted from the coil spring 45 of the torque-exerting unit 42 through the lifter 43 and the opposite-phase cam 41 are exerted in the opposite direction to each other, thus canceling each other. Since the torque combined from the valve spring torque and the opposite-phase torque is exerted on the electric motors 11 and 12 as a driving torque, the driving torque exerted on the electric motors 11 and 12 are reduced, thus, the rated torque required for the electric motors 11 and 12 are reduced, thereby achieving a reduced-sized electric motor. Furthermore, since the opposite-phase cam 41 is employed to each of the cam shafts 17 and 30 and each one of the opposite-phase cams 41 is shared by the two cylinders 2, the torque-reducing mechanism is also reduced in size as compared with the case of employing an opposite-phase cam for each cylinder 2, thereby achieving the valve driving device 10 in a further compact form. Although in the above a case of driving the cam shafts 17 and 30 to rotate continuously rotating at the standard speed is described, the same effect is also obtained on the reduction of the driving torque in the cases of varying the speed or rotation direction, since the relationship between the valve spring torque and the opposite-phase torque is in an opposite-phase to each other. Furthermore, only the valve spring torque is considered as a target to be canceled by the opposite-phase torque; however, the opposite-phase torque may be determined by further considering the torque produced due to inertia of the cams 16, etc.

Figure 10:
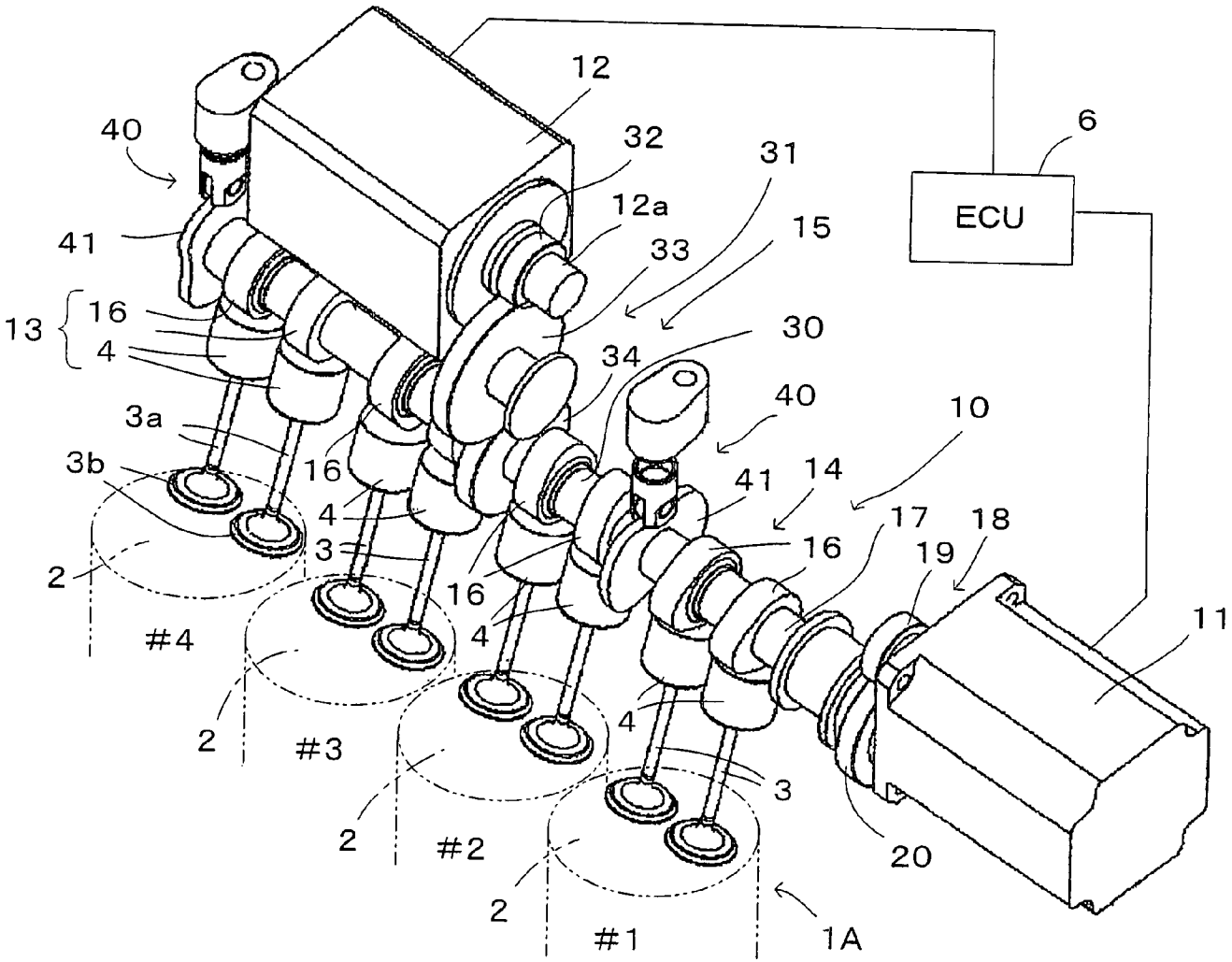
FIG. 10 is a view showing an embodiment in which an engine controller unit is provided as an electric motor control device in the valve driving device of FIG. 1.

Next, controls of the electric motors 11 and 12 are described in detail with reference to FIGS. 10 to 17. It is assumed that the operations of the electric motors 11 and 12 are controlled by the electronic control unit 6 (ECU) as shown in FIG. 10. The electronic control unit 6 is a computer unit including a microprocessor and peripheral components, such as a memory, required for the operation of the microprocessor. The electronic control unit 6 may be employed as a dedicated unit for controlling the electric motors 11 and 12 or as a unit, for example an engine control unit, which is also used for other purposes. In FIG. 10, the other parts except for the ECU 6 are the same as those in FIG. 1.

Although the control of the electric motor 11 serving the first group of cylinders (the #1 and #4 cylinders) is described hereinafter, the electric motor 12 for the second group of cylinders (the # 2 and #3 cylinders) can be controlled in the same way, unless otherwise specified. Furthermore, it is assumed in the following that when the cams 16 and cam shaft 17 are driven continuously to rotate in one direction at the above-mentioned standard speed, the intake valves 3 of the #1 and #4 cylinders opens and closes at the interval of 360 deg.CA as shown in FIG. 2B, and that the working angle of each of the valves 3 is set to 240 deg.CA (referred to as a standard working angle), and it is described that variations of the lift amount and the working angle are described with respect to these conditions. Namely, a profile of the cam 16 is designed such that the working angle of the intake valve 3 is set to 240 deg.CA. Wave forms of lift amounts shown in broken lines in FIG. 11, 12, 15, and 16 corresponds to those of when the cam speeds are fixed at the standard speed. In these figures, the notation 'CA' for a crank angle is omitted.

[Variable Control of Working Angle]

Figure 11:
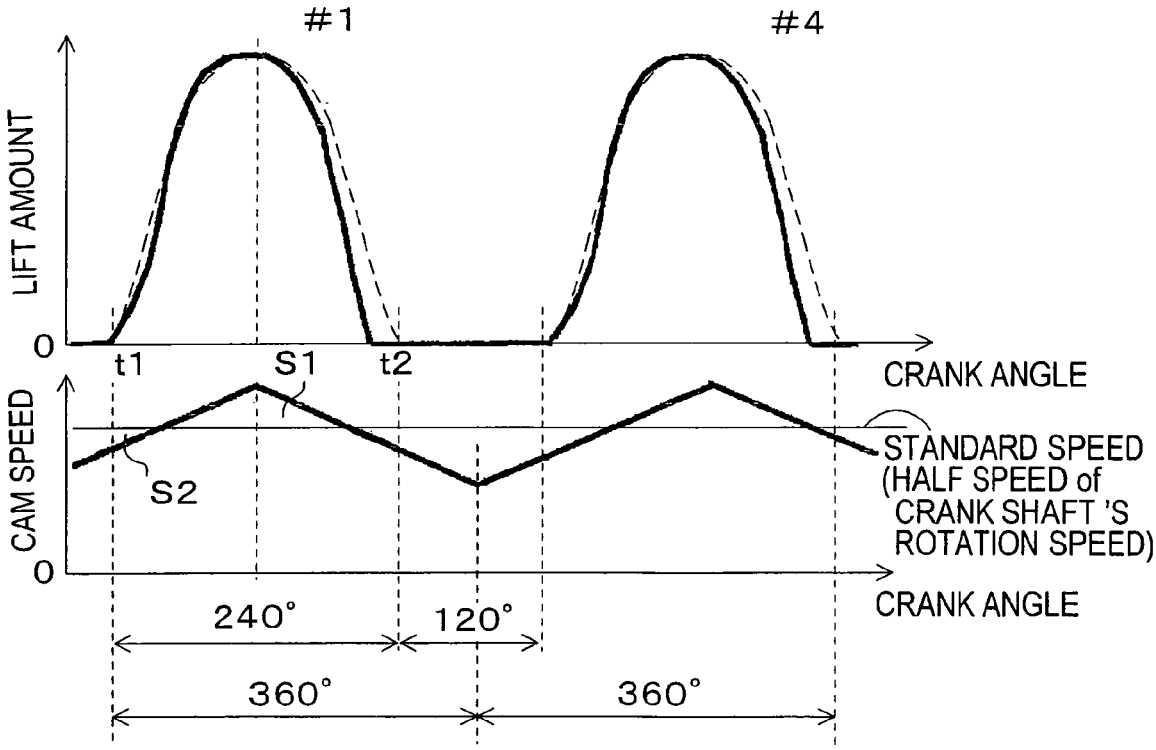
FIG. 11 is a diagram showing relationships of a cam speed, and lift amount of the intake valve to a crank angle when the electric motor is controlled to decrease the working angle of the intake valve.

The ECU 6 controls the rotation of the electric motor 11 to rotate the cam shaft continuously in one direction and to vary the rotation speed of the cam shaft 17 appropriately, thereby changing the varying characteristics of the working angle and the lift amount of the intake valve 3. FIG. 11 shows an example of the case. FIG. 11 shows relationships of the cam speed (the rotation speed of the cam 16), the lift amount of the intake valve 3, and the crank angle when the working angle of the intake valve 3 are varied by changing the rotation speed of the output shaft 11*a* of the electric motor 11 at an interval of 360 deg.CA while driving the intake valve 3 to open and close by rotating the cam shaft 17 continuously and unidirectionally. In this example, the cam speed is varied at a 360 deg.CA interval so as to make the cam speed at the maximum while the intake valve 3 is open. Furthermore, the cam speed is varied so that between the timing t1 when the intake valve 3 starts opening and the timing t2 when the valve is closed the area S1 where the cam speed exceeds the standard speed is larger than the area S2 where the cam speed falls behind the standard speed. Accordingly, the working angle of the intake valve 3 decreases less than the standard working angle. Furthermore, the position where the cam speed is at the maximum is set to the position where the lift amount of the intake valve 3 becomes to the maximum in the case of fixing the cam speed to the standard speed. Furthermore, the wave form of the cam speed in a cycle is symmetrical in the horizontal direction with respect to the position where the cam speed is at the maximum.

Figure 12:
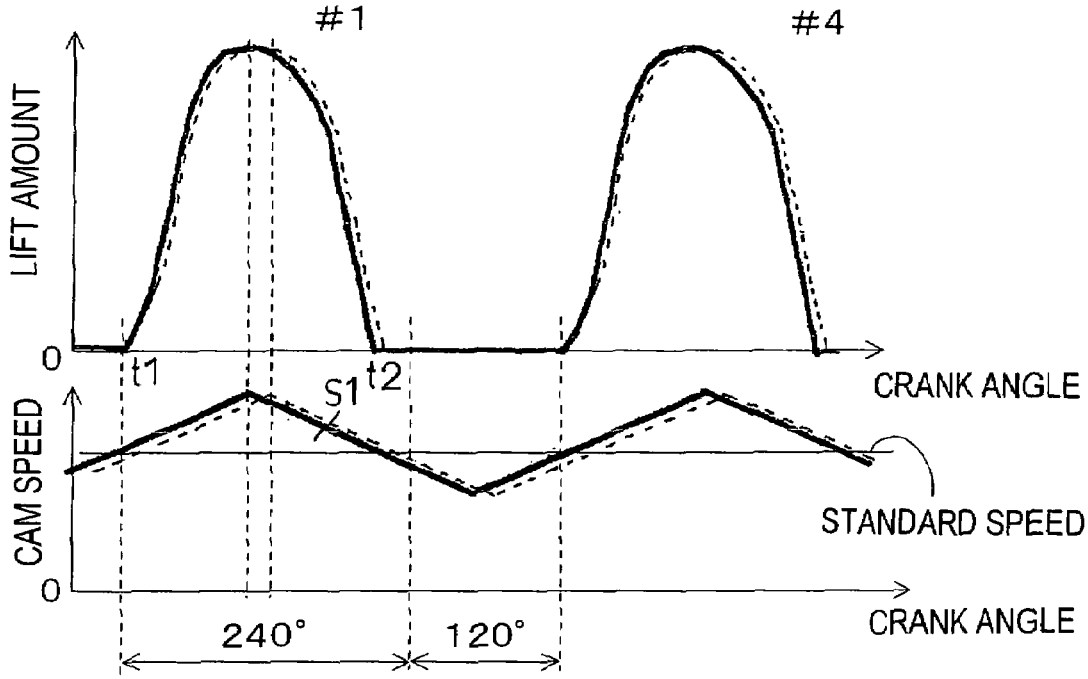
FIG. 12 is a diagram showing an embodiment in which the phase of the variation in the cam speed is altered so as to rotate the cam at the maximum speed at a position where the lift amount of the intake valve is the maximum.

FIG. 12 shows an example in which the phase of the cam speed variation in FIG. 11 is shifted so that the cam speed becomes at the maximum at the position (a maximum lift position) where the lift amount of the intake valve 3 is at the maximum when the nose head 16*c* of the cam 16 runs on the valve lifter 4. The area S2 in FIG. 11 is decreased or disappears by shifting the phase as described above. Thus, the decreased amount of the working angle with respect to the standard working angle increases. The maximum decreased amount is achieved by controlling the area S2 to disappear.

Figure 13:
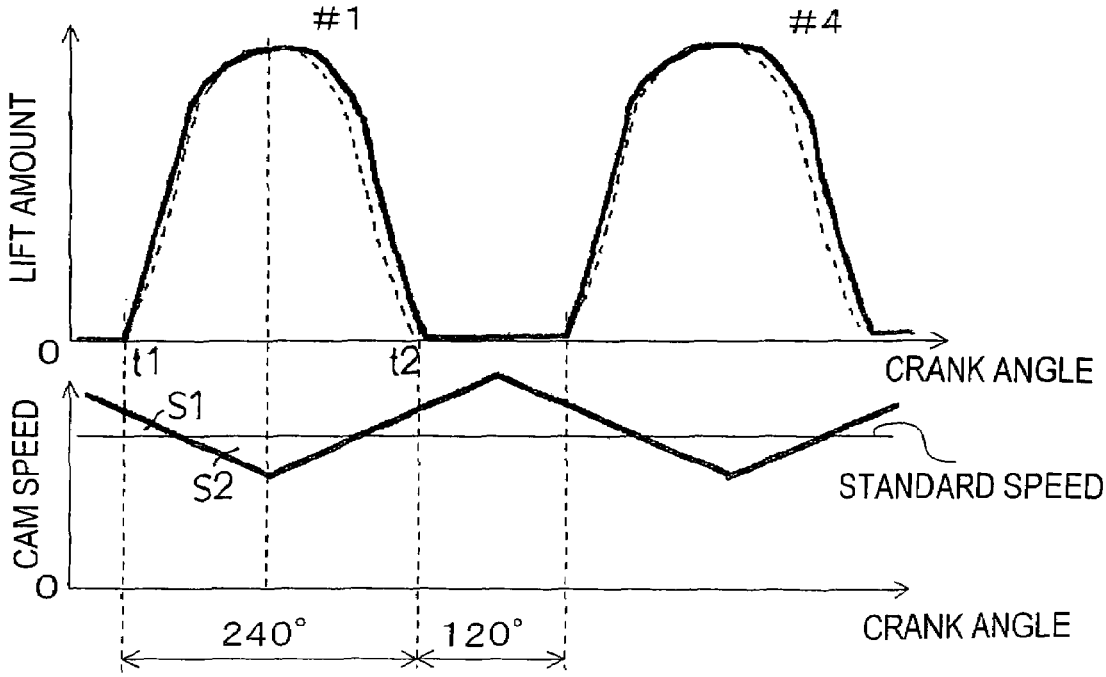
FIG. 13 is a diagram showing an embodiment in which the phase of the cam speed is altered in an opposing phase.

In an example shown in FIG. 13, the cam speed is varied at a 360 deg.CA interval so as to make the cam speed at the minimum while the intake valve 3 is opened. Namely, the cam speed is varied symmetrically in the vertical direction with respect to the standard speed corresponding to the cam speed variation in FIG. 11. Accordingly, between the timing t1 when the intake valve 3 starts opening and the timing t2 when the valve is closed, the area Si where the cam speed exceeds the standard speed is smaller than the area S2 where the cam speed falls behind the standard speed. Thus, the working angle of the intake valve 3 increases larger than the standard working angle. Furthermore, in the example shown in FIG. 13, the phase of the cam speed variation may be further shifted so that the cam speed becomes at the minimum at the maximum lift amount position of the intake valve 3. In accordance with this configuration, the increased amount of the working angle with respect to the standard working angle may be enhanced.

In addition to the above, the wave form of the variation of the lift amount-may be set asymmetric before and after the maximum lift position, such that the working angle is made to agree with the standard working angle or the difference between them is suppressed, for example, by accelerating the cam speed while the lift amount of the intake valve 3 increases and slowing down the cam speed while the lift amount decreases. It is possible to vary the working angle or lift characteristics of the intake valve 3 employed to each of the #1 and #4 cylinders by executing the above control of operations at a 360 deg.CA interval. Since the variation of the cam speed is at a 360 deg.CA interval, a variation of the operating characteristics in an intake valve 3 of a cylinder does not affect on the variation of the operating characteristics in an intake valve of the other.

[Variable Lift Control]

Figure 14A:
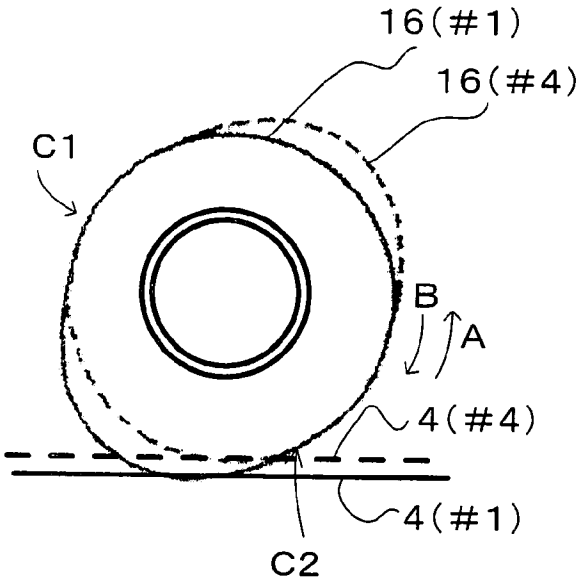
FIGS. 14A to 14C are view showing an aspect in which the intake valves of two cylinders are opened and closed by a swing of the cam.
Figure 14B:
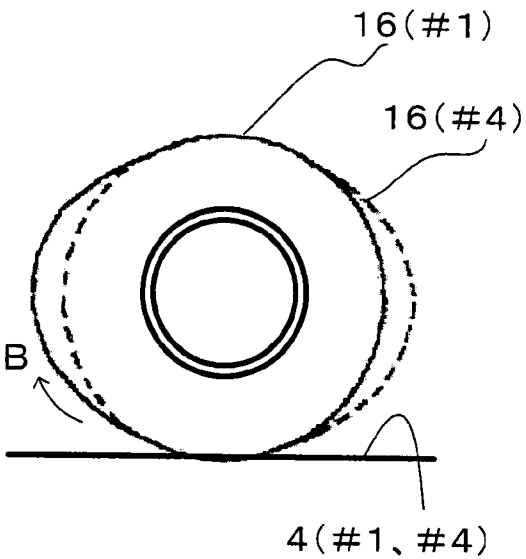
Figure 14C:
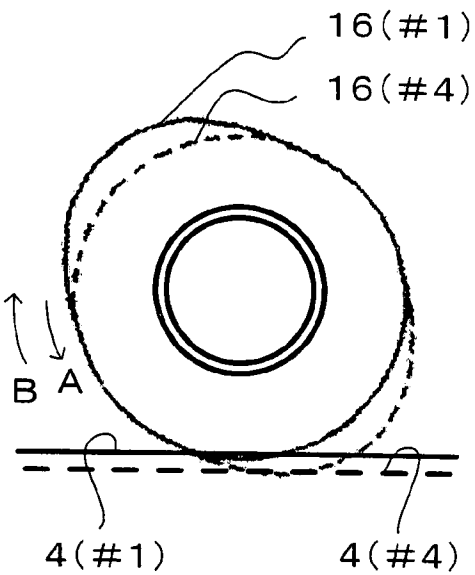

The ECU 6 is capable of varying the maximum lift amount of the intake valve 3 by swinging the output shaft 11*a* of the electric motor 11 in the opposite two directions such that the rotation direction of the cam 16 is altered, that is, by alternately changing the rotation direction of the output shaft 11*a* for every predetermined rotation angle, while the intake valve 3 is open. An example of the operation of the cam 16 in this case is shown in FIGS. 14A to 14C. In FIGS. 14A to 14C, solid lines represent the cam 16 and the valve lifter 4 for the #1 cylinder, and broken lines represent the cam 16 and the valve lifter 4 for the #4 cylinder. In the swing control, the valve lifter 4 is pushed down through the nose portion 16*b* of the cam 16 by rotating the cam 16 of the #1 cylinder, for example, in the direction shown with the arrow A in FIG. 14A, the rotation direction of the cams 16 is then reversed in the direction of arrow B before the nose head 16*c* of the cam 16 reaches the valve lifter. Then, the rotation direction of the cam 16 is maintained so that the region X shown in FIG. 5 passes through on the valve lifter 4 as shown in FIG. 14B. Thereafter, the rotation direction of the cam 16 is maintained, and the valve lifter 4 is pushed down by the nose portion 16*b* of the cam 16 of the #4 cylinder as shown in FIG. 14C. The rotation direction of the cams 16 is again reversed in the direction of arrow A before the nose head 16*c* of the cam 16 of the #4 cylinder reaches the valve lifter 4. By repeating this swing motion, the intake valves 3 of respective cylinders are sequentially opened and closed while restricting the peak lift amount of each one of the #1 and #4 cylinders less than the maximum lift amount.

Figure 15:
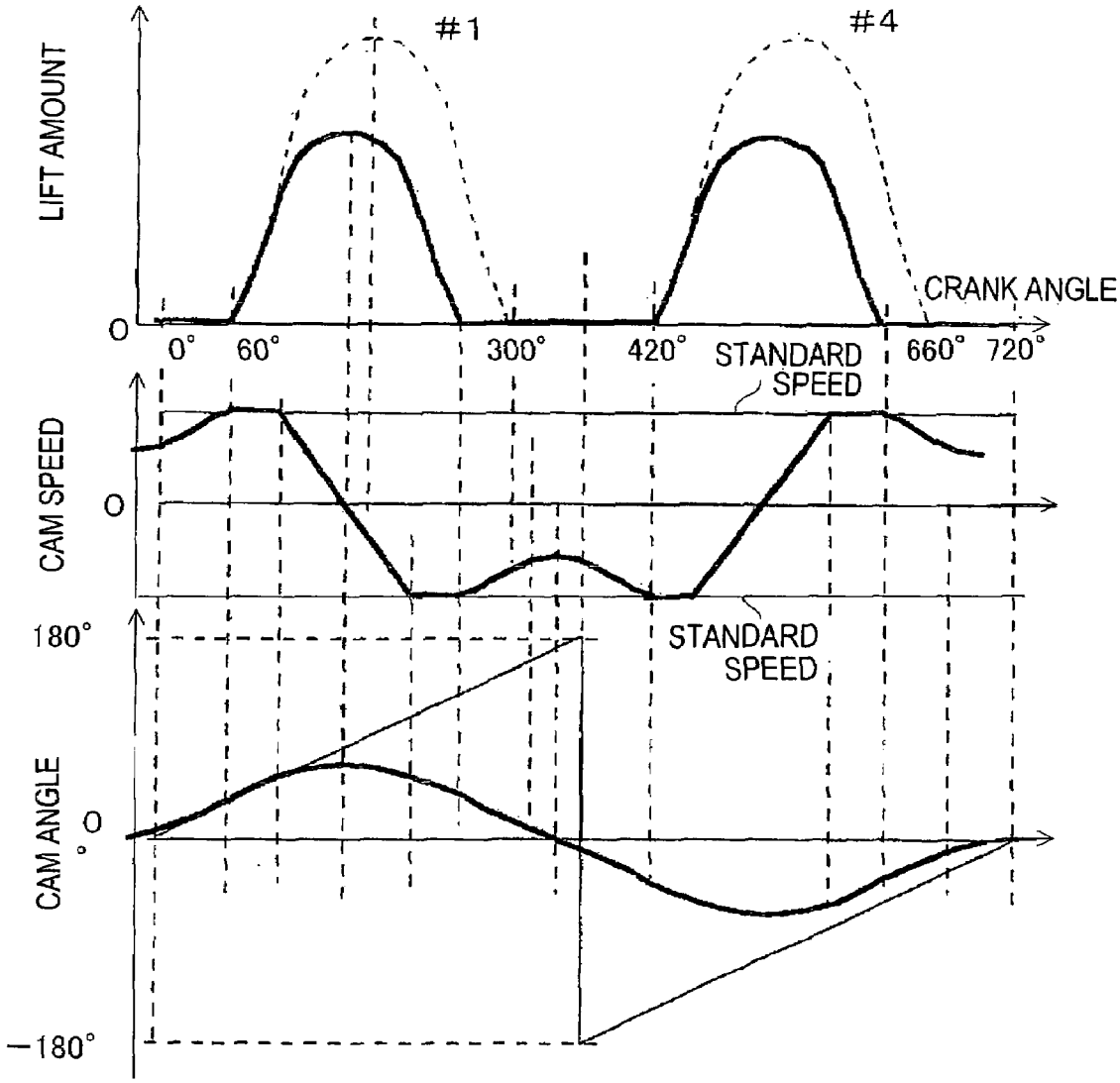
FIG. 15 is a diagram showing relationships of a cam angle, a cam speed, and lift amount of the intake valve to a crank angle when the intake valves in two cylinders are opened and closed by a swing of the cam.

FIG. 15 shows an example of the relationships of a rotation angle of the cam (a cam angle), a cam speed, lift amount of the intake valve 3 and a crank angle in the swing control. The cam angle is defined to be positive when the cam is rotated in the direction that the nose portion 16*b* of the cam 16 pushes down the valve lifter 4, namely in the direction of arrow A in FIG. 14A, with respect to the state when an intersection of the base circle 16*a* and the line passing through the center of the base circle 16*a* and the nose head 16*c* faces the valve lifter 4. The cam speed is also defined in the same manner.

In the example shown in FIG. 15, the cams 16 is accelerated while the base circle 16*a* of the cam 16 of the #1 cylinder faces the valve lifter 4 (when the crank angle is between 0-60 deg.CA), the cam 16 is rotated at the standard speed (corresponding to the rotation in the direction of arrow A in FIG. 14A) for a certain the timing when the nose portion 16*b* starts pushing down the valve lifter 4, that is, the timing when the intake valve 3 starts lifting. Thereafter, the cam 16 starts to be slowed down in the course of lifting the intake valve 3, then the cam is temporally stopped (a position in FIG. 15 where the cam speed is zero and the lift amount of the #1 cylinder is at the maximum), and the rotation direction of the cam 16 is reversed. After the reversal, the cam speed is increased to the standard speed and the rotation speed (corresponding to the rotation in the direction of the arrow B in FIG. 14A) is maintained until the intake valve 3 is closed. According to the above control, the cam 16 swings within the range smaller than 180 deg.CA, and the peak lift amount of the intake valve 3 of the #1 cylinder is restricted less than the maximum lift amount.

The peak lift amount of the intake valve 3 in the swing control can be varied appropriately by changing the range of swinging the cam 16. In FIG. 15, the peak lift amount of the intake valve 3 increases as much as a rotation angle (swing amount) of the cam 16 from the start of lifting until the cam speed becomes to be zero, on the other hand, the peak lift amount decreases as little as the amount of the swing amount. The swing range may be adjusted within a range between the maximum lift positions of the respective cylinders of #l and #4, that is, the positions where each nose head 16*c* of the respective cam 16 of the #1 and #4 cylinders runs on the valve lifter 4.

On the other hand, in the swing control, the working angle of the intake valve 3 may be altered larger or less than the standard working angle by adjusting the rotation speed of the cam 16 in the swing. In the example shown in FIG. 15, the working angle is controlled to be less than the standard working angle. In the case that the lift amount has been restricted less than the maximum lift amount, the intake amount can be restricted by further controlling the working angle less than the standard working angle in addition to the restriction of the lift amount and thus keeping the valve-opening area of the intake valve 3 (an area surrounded by the wave line representing the lift amount and an abscissa representing the crank angle) small. When the internal combustion engine 1A is thus controlled in a low load low speed rotation, pumping losses can be reduced by increasing the opening level of a throttle valve employed to an intake system of the internal combustion engine 1A.

In the case that the working angle of the intake valve 3 of the #1 cylinder has been altered with respect to the standard working angle, when the cam speed is maintained at the standard speed until the intake valve 3 of the #4 cylinder starts lifting, the timing of starting the lift of the intake valve 3 of the #4 cylinder is shifted, due to the variation of the working angle, from the originally scheduled timing, that is, the timing set after 360 deg.CA from the start timing of the lift of the intake valve 3 of the #1 cylinder. Therefore, in FIG. 15, after the intake valve 3 of the #1 cylinder has been lifted, the cam speed is slowed down temporally until the intake valve 3 of the #4 cylinder starts lifting so that the intake valve 3 of the #4 cylinder starts lifting at 420 deg.CA. In the speed control of the cam 16 after the intake valve 3 of the #4 cylinder starts lifting, only the rotation direction is different, but the speed is the same as in the #1 cylinder.

In the example shown in FIG. 15, the opening and closing of the intake valve 3 is controlled by using only one side of the nose head 16*c* of the cam 16 employed to each of the cylinders. In order to progress uniformly the uneven lubrication between the cam 16 and valve lifter 4 and wear of the cam 16, the swing ranges of the cam 16 may be switched at an appropriate interval so as to use both sides (C1 and C2 in FIG. 14A) of the nose head 16*c* of the cam 16 to drive the intake valve 3. The switching period may be determined depends on parameters such as time and the number of swings. Furthermore, the nose head 16*c* of the cam 16 is required to run over the valve lifter 4, when the ranges are switched. When the swing control of the electric motor 11 and the control of rotating the electric motor 11 continuously in one direction are selectively used in accordance with the operating condition of the internal combustion engine 1A, for example, in the case that the cam 16 is swung by the electric motor 11 in a low load low speed rotation and the cam 16 is rotated continuously in one direction by the electric motor 11 in a high load high speed rotation, the regions of the cam 16 to be used are switched before and after the continuous rotation.

[Control of Partially Deactivated Cylinder Operation]

In a low speed operation or a low load operation of an internal combustion engine, a reduced cylinder operation may be required, in which combustion stops in a part of cylinders by keeping intake valves in the part of the cylinders in the closed state. A specialized valve stopper is required for the reduced cylinder operation of a mechanical valve driving device that transmits rotation of a crankshaft to a valve. However, according to the valve driving device 10 of the embodiment, each pair of cams 16 driven by the same electric motor 11, 12 have the above-mentioned region X, thus the reduced cylinder operation is easily accomplished through the ECU 6 by swinging the electric motors 11, 12 in the opposite two directions or stopping the motor. A few examples are described hereafter.

Figure 16:
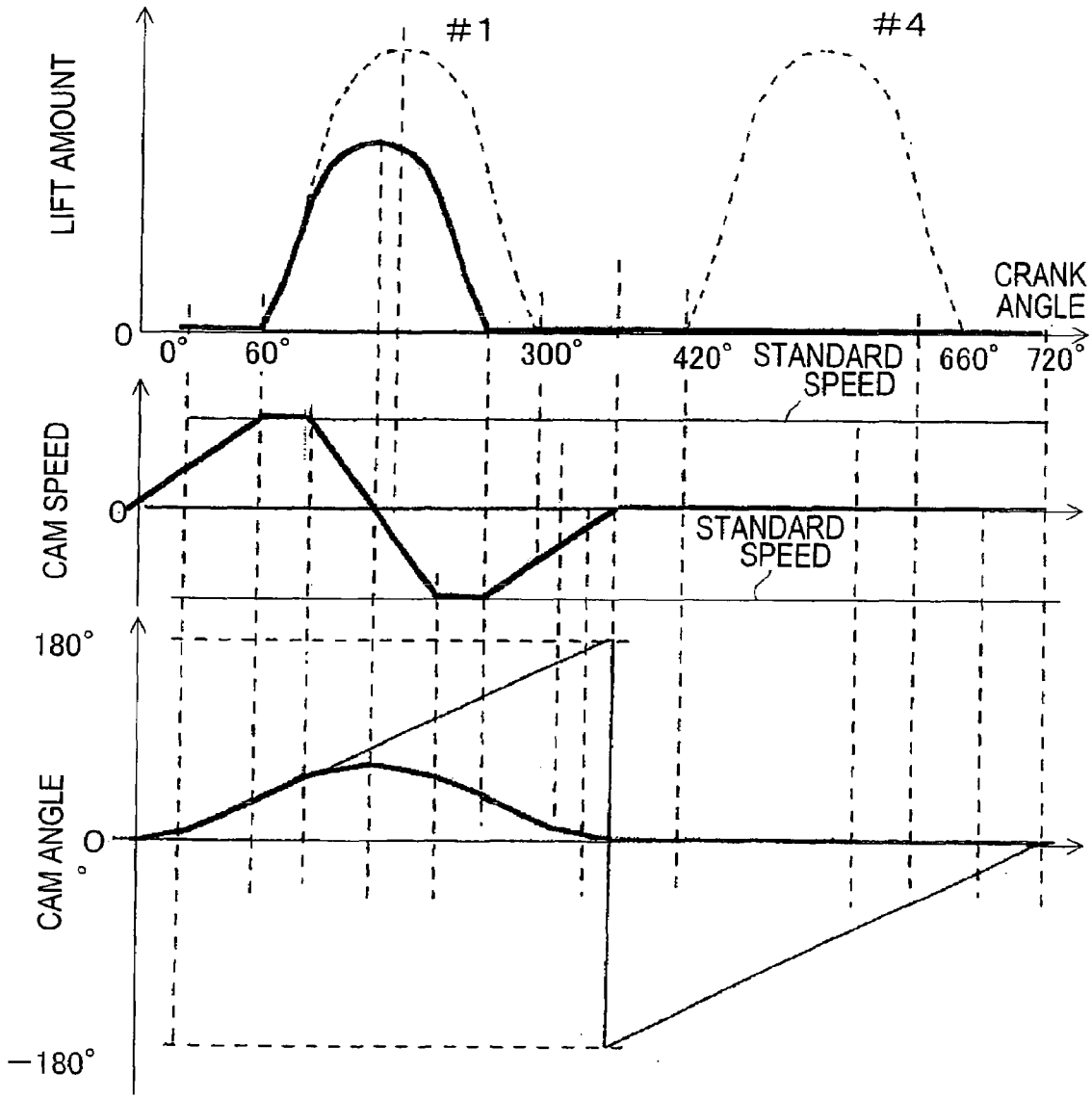
FIG. 16 is a diagram showing relationships of a cam angle, a cam speed, and lift amount of the intake valve to a crank angle when the intake valve in one cylinder is opened and closed and the intake valve of the other cylinder is stopped to open and close by a swing of the cam.

FIG. 16 shows an example in which the combustion in the #4 cylinder stops by swinging the electric motor 11 in the opposite two directions. In this example, the cam speed and cam angle are controlled in the same way as in FIG. 15 until the intake valve 3 of the #1 cylinder ends lifting. After the intake valve 3 of the #1 cylinder ends lifting, the cam 16 slows down and stops at the end point (360 deg.CA) of the control period of the electric motor 11 involved with the #1 cylinder. At this point, the cam angle is zero and all of the cams 16 of the #1 and #4 cylinders are positioned such that their base circles 16*a* face the valve lifters 4. The cam 16 remains stopped from this state to the end point (720 deg.CA) of the control period of the electric motor 11 involved with the #4 cylinder. Thereafter, the intake valve 3 of the #1 cylinder lifts again. Through the above control, it is possible to stop the intake valve 3 of the #4 cylinder in a closed state, while opening and closing the intake valve 3 of the #1 cylinder. And it is also possible to open and close the intake valve 3 of the #4 cylinder, and to stop the intake valve 3 of the #1 cylinder in a closed state.

Figure 17A:
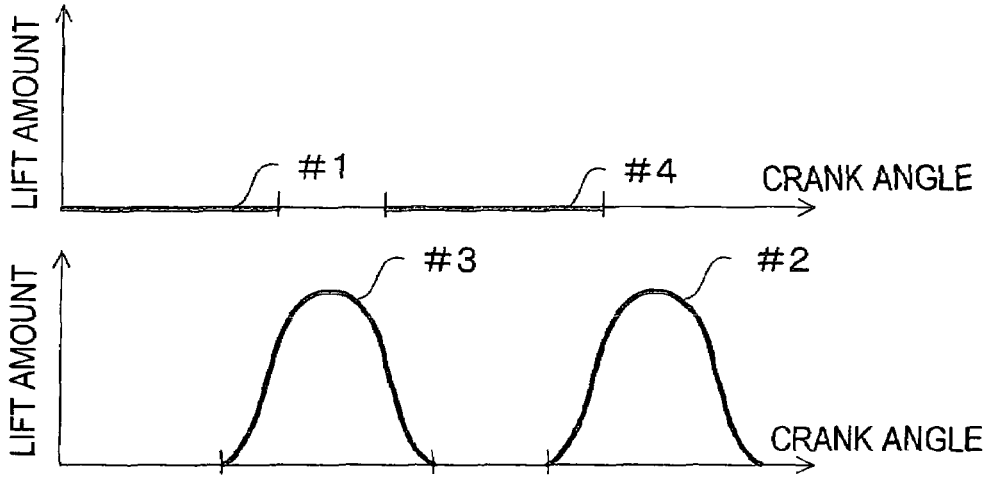
FIGS. 17A to 17C are diagrams showing an embodiment of a combination of stopped cylinders and operating cylinders when the intake valves of some cylinders stop and the intake valves in the other cylinders open and close.

By stopping the electric motor 11 between 0 deg.CA to 720 deg.CA in a state in which the above-mentioned region X faces the valve lifter 4, that is, all of the intake valves of a same group of cylinders are closed, any of intake valves 3 of the cylinders in the same group of cylinders (for example, the #1 and #4 cylinders) may be stopped as shown in FIG. 17A. In this case, the electric motor 12 drives each cam 16 of the other group of cylinders (the #2 and #3 cylinders) to open and close the intake valves 3 of the cylinders, thereby combusting the remaining two cylinders of #2 and #3 at a 360 deg.CA interval while keeping the two cylinders in the state of non-combusting. Furthermore, the electric motor 12 may stop where all intake valves 3 of the # 2 and #3 cylinders close, whereas the electric motor 11 may drive the cams 16 of the #1 and #4 cylinders to open and close their intake valves 3.

Figure 17B:
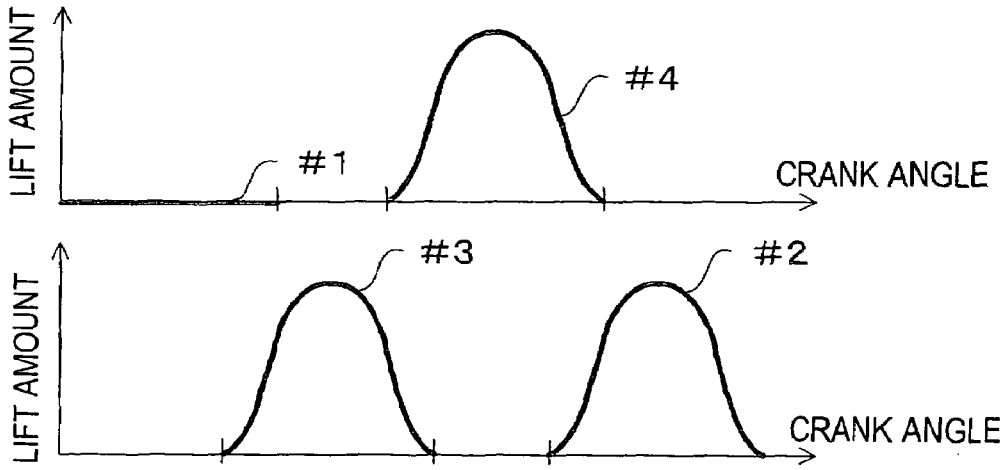
Figure 17C:
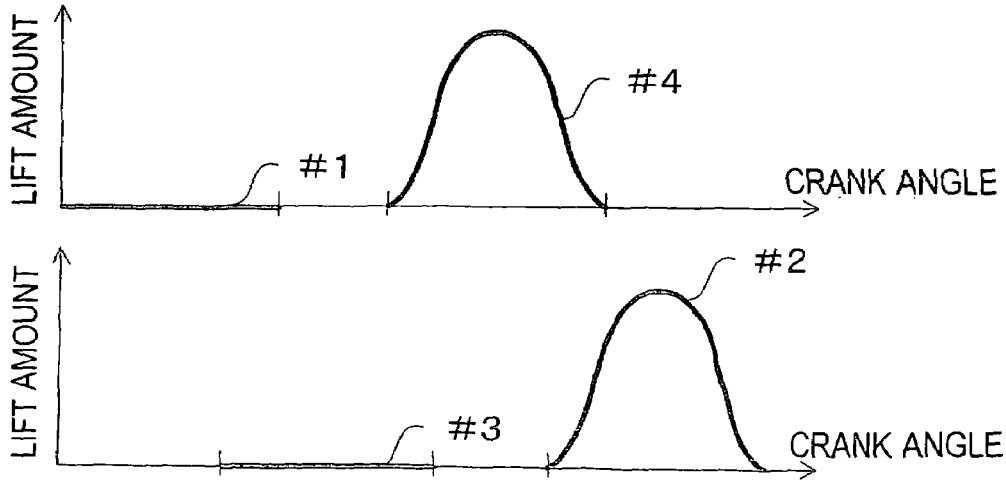

Alternatively, in the reduced cylinder operation, the number of non-operating cylinders may be altered appropriately within the range (1 to 3) lower than the total number of cylinders by combining the swing and the stop of the electric motor 11 or 12. For example, FIG. 17B shows an example in which only the #1 cylinder stops combusting and FIG. 17B shows an example in which the #1 and # 3 cylinders stop combusting. Preferably, the number of the non-combusting cylinders and the non-combusting cylinder numbers which are not in combustion are selected depending on the operating condition of the internal combustion engine 1A. Since the non-combusting cylinder is selected with relative ease as described above, the pumping loss is reduced in the reduced cylinder operation and the internal combustion 1A can be operated in a highly-efficient condition. Accordingly, fuel efficiency is expected to be improved. Further, the working angle of the intake valve 3 and the lift amount in the combusting cylinder is variable by the control as described above, while a part of cylinders are non-combusting. In this case, the pumping loss in the internal combustion engine 1A can be controlled more precisely as compared to when the cam 16 of the combusting cylinder rotates continuously at the standard speed, thereby adjusting the engine brake force more minutely.

In the above description, the operating characteristics of the intake valve 3 are described with regard to the rotation speed or rotation direction of the cam 16. However, considering a reduction ratio or a rotation direction relationship between the electric motors 11 and 12 and the cam 16, it is possible to replace the rotation speed or rotation direction of the cam 16 with the rotation speed or the rotation direction of the output shaft 11*a* and 12*a* of the electric motors 11 and 12, respectively. The above operating characteristics of the intake valve 3 are variable through control of the electric motors 11 and 12 by the ECU 6 according to the replaced rotation speed and rotation direction of the output shafts 11*a* and 12*a*. For example, information on the operating condition of the internal combustion engine 1A and the operating of the cam 16, such as relationships of the rotation speed, the rotation direction, the operating control modes of the cam 16 (a control mode of rotating continuously in one direction and a swing control mode), and the swing range in the swing control mode (specified with the cam angle or the swing angle at a point where the rotation direction changes), is memorized in a ROM of the ECU 6 in advance and the operating condition is determined by information from a variety of sensors in the internal combustion engine 1A. The operating condition of the cam 16 is specified by the determined result. By controlling the electric motors 11 and 12 having the operating characteristics of the output shaft that is replaced with the operating condition of the output shafts 11*a* and 12*a*, the operating characteristics, such as the above-mentioned working angle, lift characteristic, the maximum lift amount, and the number of the non-combusting engine, are variable. In this case, a crank sensor or a cam angle sensor detects the crank angle or the rotating position of the cam shafts 17 and 30, thereby feedback-controlling the electric motors 11 and 12.

Figure 18:
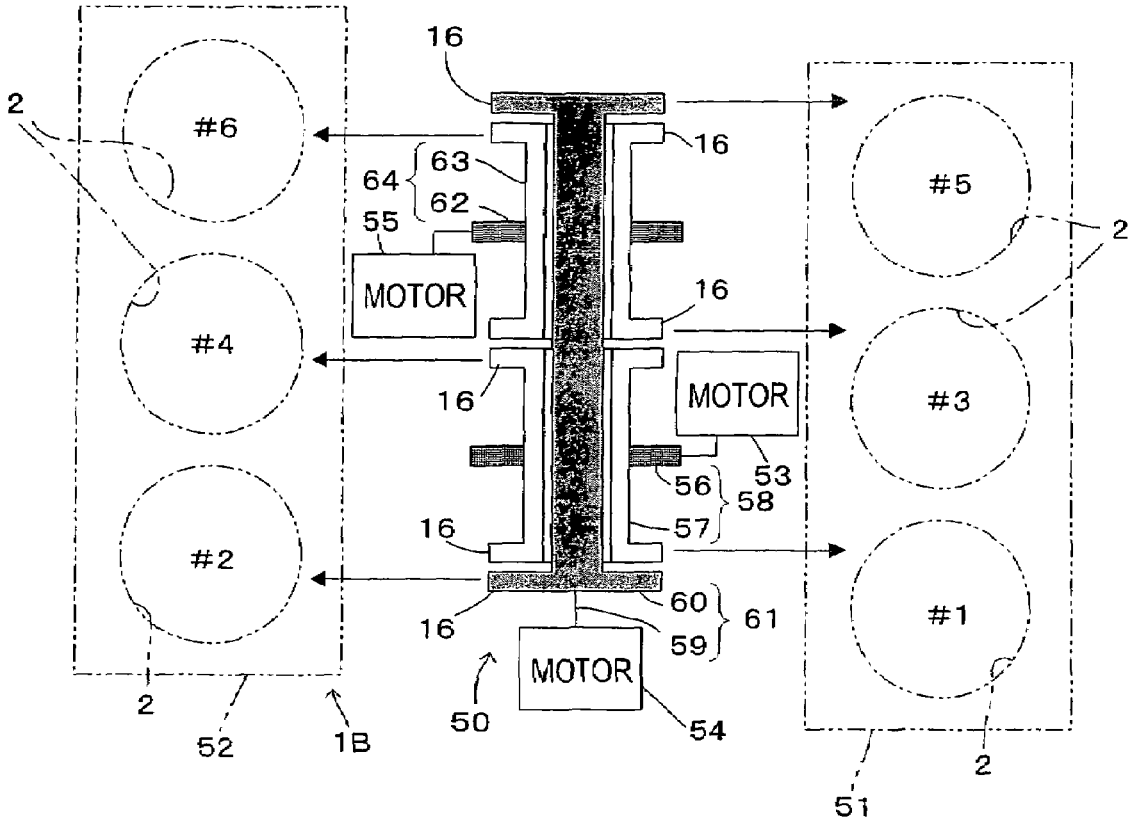
FIG. 18 is a view showing an embodiment in which the valve driving device is applied to a V-type six-cylinder internal combustion engine.

The present invention is not limited to the above embodiments and may be modified and altered. For example, an in-line four-cylinder internal combustion engine is described in the invention; however, a plurality of cylinders may be employed when all cylinders in which open-valve periods are not overlapped are distinct from each other in a group of cylinders. FIG. 18 shows a V-type six-cylinder internal combustion engine 1B where the valve driving device 50 is employed. In this internal combustion engine, cylinders 2 (#1, #3, and #5) and (#2, #4, and #6) are arranged in a line in one bank 51 and the other bank 52, respectively. Firing occurs in the order of the cylinder number, i.e. #1→#2→#3→#4→#5→#6. Also, a bank angle is set to 60 deg., therefore; the firing impulses are generated every 120 deg.CA.

Figure 19A:
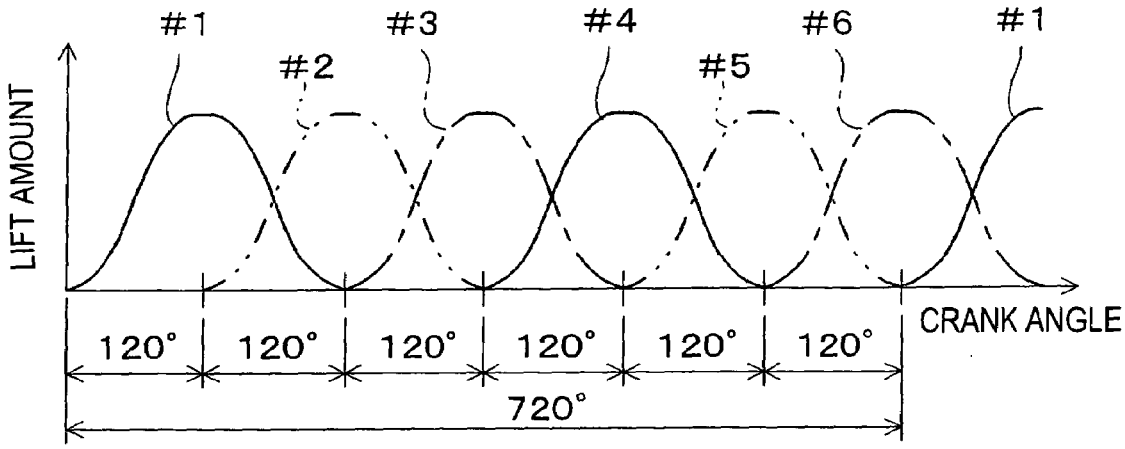
FIG. 19A is a diagram showing relationships of the lift amount of each valve to a crank angle when the standard working angle is set to 240 deg.CA in the internal combustion engine of FIG. 18.

In the valve driving device 50 applied to the internal combustion engine 1B, cylinders at an interval of 360 deg.CA from another belongs to a group of cylinders, therefore, three motors 53, 54, 55 are required to operate valves of each cylinder. When the standard working angle is 240 deg.CA, the lift amount of each intake valve corresponds to a crank angle as shown in FIG. 19A. Accordingly, in FIG. 18, a first group of cylinders includes the #1 and #4 cylinders, a second group of cylinders includes the #2 and #5 cylinders, and a third group of cylinders includes the #3 and #6 cylinders, and the three motors are provide for the first, second, and third groups of cylinders.

Rotational movement of the first electric motor 53 is transmitted to a cam 16 for the #1 and #4 cylinders through a transmitting mechanism 58 including a gear train 56 and a cam shaft 57. Rotational movement of the second electric motor 54 is transmitted to cams 16 for the #2 and #5 cylinders through a transmitting mechanism 61 including a gear train 59 and a cam shaft 60. Rotational movement of the third electric motor 55 is transmitted to a cam 16 for the #3 and #6 cylinders through a transmitting mechanism 64 including a gear train 61 and a cam shaft 63. The cam shaft 60 for the #2 and #5 cylinders has the same structure as the cam shaft 17 in FIGS. 3 and 4. The cam shafts 57 and 63 are hollow, coaxially positioned at the periphery of the cam shaft 60, and are capable of rotating. The cam shafts 57, 60, 63 are positioned between the banks 51 and 52, a rotation of each cam 16 for the cam shafts 57, 60, 63 is converted into a linear motion of a follower (not shown). The linear motion of the follower is transmitted to valves including the intake valves through a motion-transmission unit such as a push rod, thus the valves reciprocate. The internal combustion engine 1B shown in FIG. 18 is an OHV-Type.

In this configuration, the open-valve periods in each of the groups of cylinders also do not overlap as in FIG. 2A, the number of electric motors involved decreases as much as the operating characteristic of the respective valve is improved, thereby achieving a reduced-sized valve driving device. Also, the cams 16 in the same group of cylinders may be controlled in the same way as described above. Each of the cam shafts 57, 60, 63 has the torque-reducing mechanism 40, in FIG. 18.

Figure 19B:
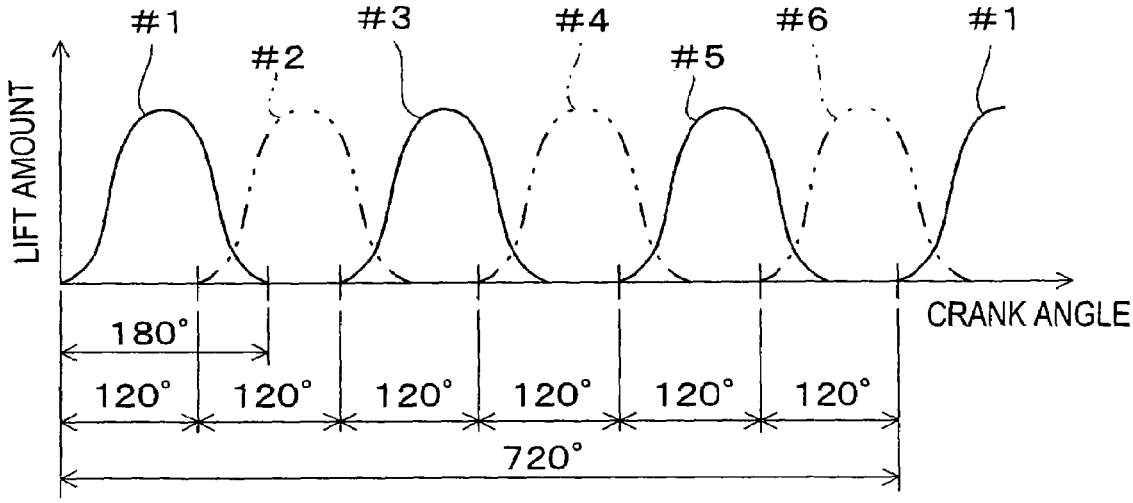
FIG. 19B is a diagram showing relationships of the lift amount of each valve to a crank angle when the standard working angle is set to 180 deg.CA in the internal combustion engine of FIG. 18.

In FIG. 18, even though one group of cylinders has two cylinders, in the case of setting the standard working angle as 180 deg.CA, the open-valve periods in the #1, #3, and #5 cylinders do not overlap and those in the #2, #4, and #6 cylinders also do not overlap, as shown in FIG. 19B. In this case, the first group of cylinders may consist of the #1, #3, and #5 cylinders and the second group of cylinders may consist of the #2, #4, and #6 cylinders, and the valve driving device 10 according to the invention is applicable to this configuration. In other words, the groups of cylinders may be included in every bank in the present invention.

Figure 20:
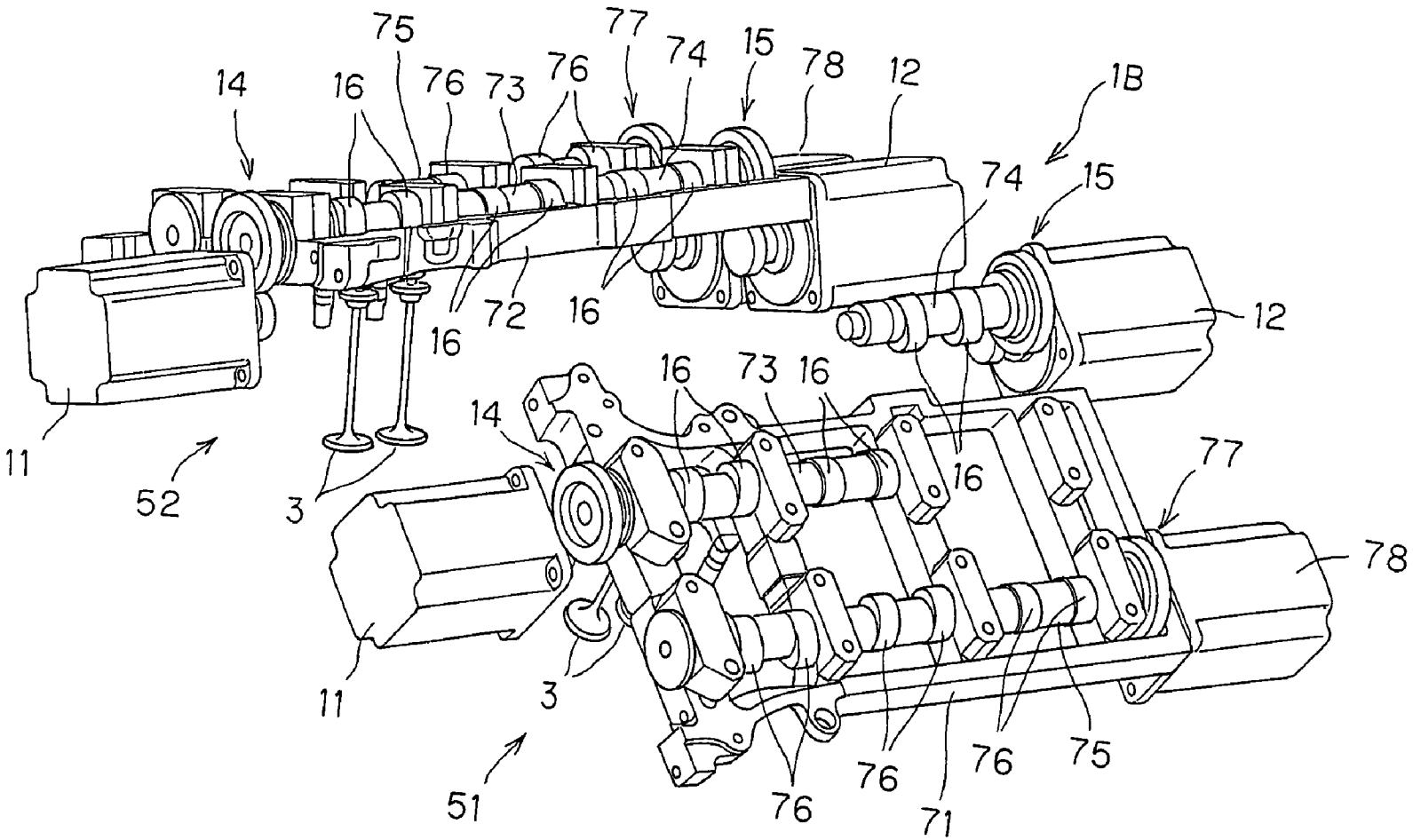
FIG. 20 is a view showing another embodiment in which the valve driving device is applied to a V-type six-cylinder internal combustion engine according to the present invention.

FIG. 20 shows another embodiment in which the valve driving device is applied to a V-type six-cylinder internal combustion engine. In this embodiment, cam carriers 71 and 72 are provided to a pair of banks 51 and 52, respectively. Each of the cam carriers has two cam shafts 73 and 74 to operate intake valves 3 and one cam shaft 75 to operate exhaust valves (not shown). All the cam shafts are coaxially fitted on the corresponding carrier and capable of rotating, and coaxially positioned. In FIG. 20, even though the cam shaft 74 in the bank 51 is separated from the cam carrier 71, in practice, the cam shafts 73 and 74 are coaxially positioned on the cam carrier 71 like the cam shaft 74 on the cam carrier 72.

Cams 16 are integrally formed with the cam shaft 73 to operate intake valves 3 corresponding to adjacent two cylinders 2 in one bank, and are capable of rotating. A cam 16 is integrally formed with the other cam shaft 74 to operate an intake valve 3 corresponding to the other cylinder 2 in the same bank, and is also capable of rotating. The cam shaft 74 rotates through the first transmitting mechanism 14 by the first electric motor 11 and the cam shaft 75 rotates through the second transmitting mechanism 15 by the second electric motor 12. Cams 76 are integrally formed with a cam shaft 75 for exhausting so as to operate exhaust valves of all cylinders in one bank, and are capable of operating. The cam shaft 75 is rotated through a transmitting mechanism 77 by one electric motor 78. The cam 16 for each cylinder 2 has 120 deg. phase difference from one another, therefore operating characteristics of the intake valves 3 in two cylinders 2 can be independently controlled by the swing control of the first motor 11 and an operating characteristic of the intake valve 3 in the other cylinder 2 can be independently controlled by the second motor 12 regardless of the intake valves 3 in the two cylinders 2.

Figure 21:
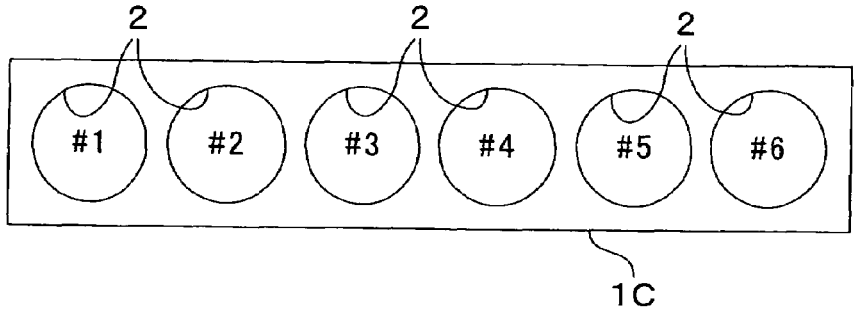
FIG. 21 is a view showing an example of a cylinder arrangement and a cylinder numbering in an in-line six-cylinder internal combustion engine.
Figure 22A:
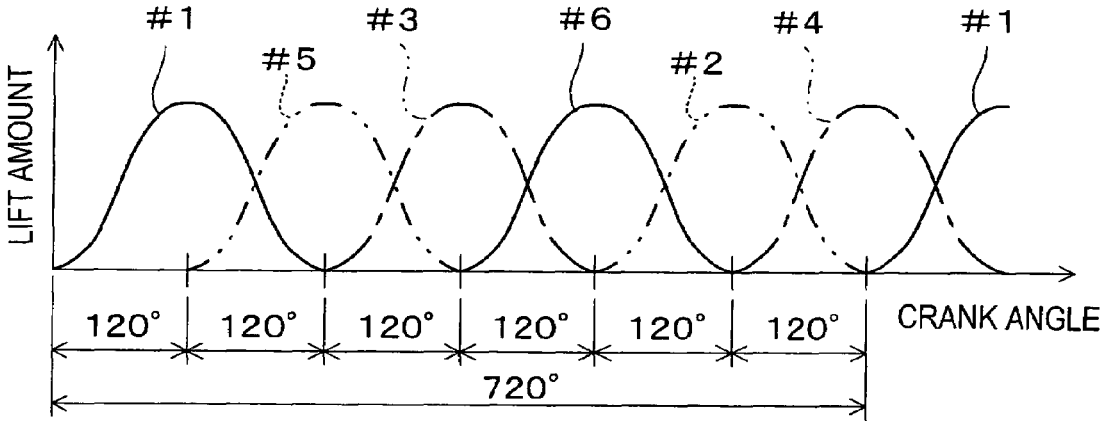
FIG. 22A is a diagram showing relationships of the lift amount of each valve to a crank angle when the standard working angle is set to 240 deg.CA in the internal combustion engine of FIG. 20.
Figure 22B:
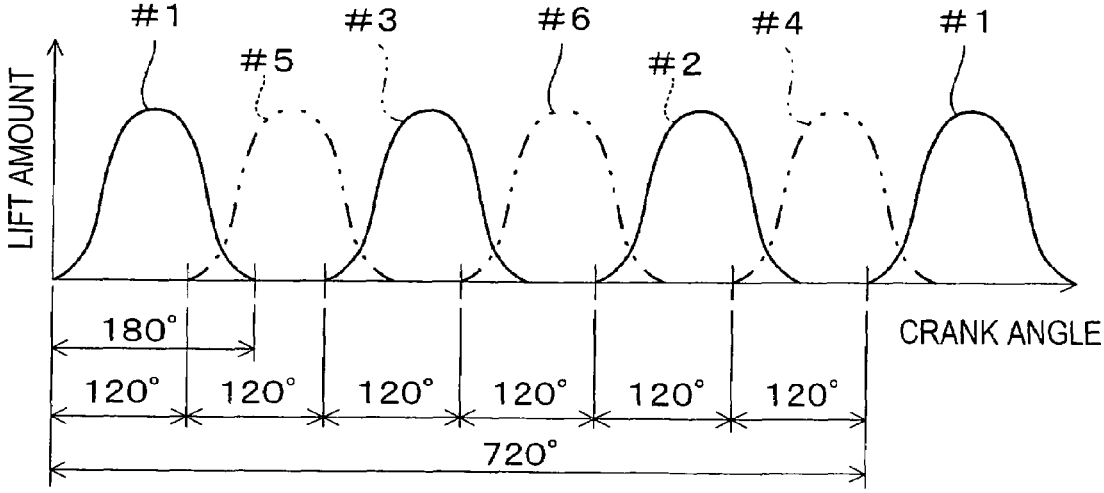
FIG. 22B is a diagram showing the relationships of the lift amount of each valve to a crank angle when the standard working angle is set to 180 deg.CA in the internal combustion engine of FIG. 20.

The present invention is applicable to an in-line six-cylinder, V-type eight-cylinder, or V-type twelve-cylinder internal combustion engine. In an in-line six-cylinder internal combustion engine 1C shown in FIG. 21, cylinders 2 are numbered #1 to #6 from one end to the other end and the firing sequence of the cylinders is #1→#5→#3→#6→#2→4. FIG. 22A shows a relationship between a lift amount of each intake valve and a crank angle when a standard working angle of each cylinder valve is 240 deg.CA, in which case a first, second, and third groups of cylinders consist of the #1 and #6, the #2 and #5, and the #3 and #4 cylinders, respectively, and the valve driving device according to the invention is applicable to this configuration. FIG. 22B shows a relationship between a lift amount of each intake valve and a crank angle when a standard working angle for each intake valve is set to 180 deg.CA in the in-line six-cylinder internal combustion engine 1C, in which case a first and second groups of cylinders consist of the #1, 2, and 3, and the #4, #5, and #6 cylinders, respectively, the firing sequence is #1→#4→#2→#6→#3→#5 and the valve driving device is also applicable to this configuration.

In a case of applying to a V-type eight-cylinder internal combustion engine. Since four cylinders are arranged in a line in each bank, therefore, the above embodiment is available considering each of the banks as an in-line four-cylinder internal combustion engine. In a V-type twelve-cylinder internal combustion engine, six cylinders are arranged in a line in each bank, therefore, the above embodiment is also available considering each of the bank as an in-line six-cylinder internal combustion engine. Further, when a variable-cylinder control is performed, the number of non-combusting cylinders may be selected within 1 to 5 in the six-cylinder internal combustion engine, 1 to 7 in the eight-cylinder internal combustion engine, and 1 to 11 in the twelve-cylinder combustion engine.

As described above, in the present invention, the number of cylinders opened by one motor and the combination thereof, and the number of electric motors are preferably determined in order for open-valve periods to do not overlap in relation to an adjustable amount of a working angle. In other words, they may be determined such that the open-valve periods do not overlap in one group of cylinders even if the working angle varies. The above-mentioned embodiments do not limit the number of electric motors, the number of cylinders and a layout thereof, and a combination of cylinders controlled by one motor.

In the above embodiment the intake valve 3 is shown; however, the present invention is also applicable to an exhaust valve. The operating condition of the internal combustion engine may be controlled by controlling the exhaust valve according to the invention and varying an exhausting efficiency of each cylinder. Furthermore, both intake and exhaust valves may be controlled according to the invention. The speed reducer 18 and 31 may not be essential in the embodiments according to the invention, or may be directly connected with the output shafts 11*a* and 12*a* and the cam shafts 17 and 30. Preferably, the reduction ratios of the speed reducers 18 and 31 are set to the same level to easily control the speed of the electric motors 11 and 12. The torque-reducing mechanism 40 may not be essential in the embodiments according to the invention. In case of providing the torque-reducing mechanism 40, the opposite-phase cam 41 is not essentially provided to the intermediate gear such as the cam shafts 17 and 30 and may be provided to the speed reducer 18 and 31. In this case; however, the rotation speed of the opposite-phase cam 41 is required an integer times that of the cam shaft 17 and 30. A motion-converting device is not limited to the cam mechanism 13 and may be a link mechanism such as a slider crank mechanism, in which case a rotating body at a rotation-input part of the link mechanism may be driven by an electric motor.

As described above, with the valve driving device according to the present invention, the flexibility of controlling operating characteristics of the valves in each cylinder may be improved. Furthermore, according to the invention, the valve driving device can be reduced-sized as compared to when the electric motor is provided for each cylinder and easily mounted in a vehicle.

The invention claimed is:

1. A valve driving device for a multi-cylinder combustion engine, that converts rotational motion outputted from a valve-driving source to linear motion through motion-converting devices provided to respective cylinders and that drives valves in respective cylinders through the linear motion, the valve driving device comprising:

an electric motor that is shared as the valve-driving source in a group of cylinders comprising a plurality of cylinders, in which open-valve periods of the valves do not overlap;

a control device that controls operating characteristics of respective valves in the group of cylinders by varying at least one of rotation speed and rotation direction of the electric motor; and cam mechanisms that convert rotational motion outputted from the electric motor into linear motion of the valves, wherein each of the groups of cylinders consists of two cylinders, and the control device drives the electric motor such that the electric motor swings in opposite two directions within a range between a position where maximum lift amount is given by a cam in the cam mechanism of a cylinder in a group of cylinders and a position where maximum lift amount is given by a cam in the cam mechanism of another cylinder in the same group of cylinders, while varying the amount of swings.

2. The valve driving device for multi-cylinder combustion engine according to claim 1, further comprising:

a motion-transmission mechanism that transmits rotational motion of the electric motor to rotating bodies of respective motion-converting devices in the group of cylinders.

3. The valve driving device according to claim 1, wherein a torque-reducing mechanism that reduces driving torque generated in driving respective valves in the group of cylinders is employed in common to the group of cylinders.

4. The valve driving device according to claim 2, wherein the motion-transmission mechanism is provided with a transmission shaft that connects the rotating bodies of the respective motion-transmission devices in the group of cylinders with each other, and wherein the electric motor is connected to the motion-transmission shaft so as to transmit the rotational motion to the motion-transmission shaft.

5. The valve driving device according to claim 2, wherein the internal combustion engine is configured as an even interval firing, in-line four-cylinder four-stroke-cycle internal combustion engine, and wherein the firing interval between the outer pair of the cylinders is set to 360 deg. in terms of a crank angle in the order of firings at the cylinders, and wherein the internal combustion engine is equipped with a first electric motor shared in the motion-converting devices in a first group of cylinders consisting of the outer pair of cylinders and a second electric motor shared in the motion-converting devices in a second group of cylinders consisting of the inner pair of cylinders, as the electric motor includes, and wherein the motion-transmission mechanism includes a first motion-transmission mechanism that transmits rotational motion of the first electric motor to the rotating bodies of respective motion-converting devices in the first group of cylinders; and a second motion-transmission mechanism that transmits rotational motion of the second electric motor to the rotating bodies of respective motion-converting devices in the second group of cylinders.

6. The valve driving device according to claim 5, wherein the first motion-transmission mechanism includes a first motion-transmission shaft that connects the rotating bodies of respective motion-converting devices in the first group of cylinders; and the second motion-transmission mechanism includes a second motion-transmission shaft that connects the rotating bodies of respective motion-converting devices in the second group of cylinders, and wherein the second motion-transmission shaft is coaxially positioned outside the first motion-transmission shaft, and wherein the first electric motor is connected to the first motion-transmission shaft so as to transmit the rotational motion to the first motion-transmission shaft, and wherein the second electric motor is connected to the second motion-transmission shaft so as to transmit the rotational motion to the second motion-transmission shaft.

7. The valve driving device according to claim 2, wherein, the internal combustion engine is configured as an even interval firing, six-cylinder, four-stroke cycle internal combustion engine, and wherein a group of cylinders is configured from the cylinders, in which the firing timings between respective cylinders are set to 360 deg. in terms of a crank angle in the order of firings at the cylinders, and the electric motor and the transmission mechanism are provided to each cylinder.

8. The valve driving device according claim 2, wherein the motion-converting device is configured as a cam mechanism, and wherein the rotating body is a cam in the cam mechanism.

9. The valve driving device according to claim 1, further comprising:

cam mechanism that converts rotational motion outputted from the electric motor into linear motion of the valves, wherein the control device controls the electric motor to rotate cams of the cam mechanism rotate continuously in the same direction with a varying rotation speed such that when lift amount of the valve of a valve is at the maximum the rotation speed of a cam driving the respective valve is at the maximum or at the minimum.

10. The valve driving device according to claim 1, wherein the control device further varies the rotation speed of the electric motor during the swing.

11. The valve driving device according to claim 1, wherein the control device controls the electric motor to use both sides of the head of the nose portion of the cam in the group of cylinders alternately in driving the valve.

12. The valve driving device according to claim 1, wherein, the control device swings the electric motor in opposite two directions, such that a valve of a cylinder in a group of cylinders opens and closes and a valve of the other cylinder in the same group of cylinders remains closed in a reduced cylinder operation of the internal combustion engine.

13. The valve driving device according to claim 1, wherein the electric motor is provide as a valve-driving source to each group of cylinders consisting of a plurality of cylinders in which open-valve periods do not overlap, and wherein the control device swings at least one electric motor in opposite two directions such that a valve of a cylinder in a group of cylinders opens and closes and a valve of the other cylinder in the same group of cylinders remains closed in a reduced cylinder operation of the internal combustion engine.

14. The valve driving device according to claim 1, wherein the electric motor is employed as the valve-driving source to each of the plurality group of cylinders consisting of a plurality of cylinders in which open-valve periods do not overlap, and wherein the control device stops a part of the electric motors at the position where all valves driven by each of the motors are closed in a reduced cylinder operation of the internal combustion engine.

15. The valve driving device according to claim 13, wherein the control device controls each of the electric motors such that the number of the cylinders with their valves closed is lower than the total number of cylinders in a reduced cylinder operation of the internal combustion engine.

16. The valve driving device according to claim 13, wherein the control device controls each of the electric motors such that the number of the cylinders with their valves closed is lower than the total number of cylinders and at least one of the lift amount and working angle of a cylinder is varied in the cylinder in which the valve opens and closes in a reduced cylinder operation of the internal combustion engine.

* * * * *